US010107076B2

(12) United States Patent
Muscroft et al.

(10) Patent No.: US 10,107,076 B2
(45) Date of Patent: Oct. 23, 2018

(54) DOWNHOLE TOOLS, SYSTEMS AND METHODS OF USING

(71) Applicant: Peak Completion Technologies, Inc., Midland, TX (US)

(72) Inventors: William Sloane Muscroft, Midland, TX (US); Russell L Morgan, Houston, TX (US)

(73) Assignee: Peak Completion Technologies, Inc, Midland, TX (US)

( * ) Notice: Subject to any disclaimer, the term of this patent is extended or adjusted under 35 U.S.C. 154(b) by 321 days.

(21) Appl. No.: 14/704,679

(22) Filed: May 5, 2015

(65) Prior Publication Data

US 2015/0233208 A1 Aug. 20, 2015

Related U.S. Application Data

(63) Continuation-in-part of application No. 14/086,900, filed on Nov. 21, 2013, now Pat. No. 9,611,719.

(60) Provisional application No. 61/729,264, filed on Nov. 21, 2012.

(51) Int. Cl.

| | |
|---|---|
| ***E21B 34/10*** | (2006.01) |
| ***E21B 34/06*** | (2006.01) |
| *E21B 34/00* | (2006.01) |

(52) U.S. Cl.

CPC ..... *E21B 34/102* (2013.01); *E21B 34/063* (2013.01); *E21B 34/10* (2013.01); *E21B 2034/007* (2013.01)

(58) Field of Classification Search

CPC ..... E21B 34/102; E21B 34/10; E21B 34/063; E21B 2034/007

See application file for complete search history.

(56) References Cited

U.S. PATENT DOCUMENTS

| | | | | |
|---|---|---|---|---|
| 2,251,977 | A * | 8/1941 | Burt | E21B 33/146 137/70 |
| 4,429,747 | A * | 2/1984 | Williamson, Jr. | E21B 34/103 166/321 |
| 6,293,342 | B1 * | 9/2001 | McGarian | E21B 21/10 166/317 |
| 8,267,178 | B1 * | 9/2012 | Sommers | E21B 34/102 166/317 |
| 9,121,247 | B2 * | 9/2015 | George | E21B 34/063 |
| 2002/0066573 | A1 * | 6/2002 | Patel | E21B 34/10 166/374 |
| 2002/0166665 | A1 * | 11/2002 | Vincent | E21B 21/103 166/291 |
| 2009/0095463 | A1 * | 4/2009 | Swan | E21B 21/103 166/53 |

(Continued)

*Primary Examiner* — Blake E Michener

(57) ABSTRACT

A downhole tool comprising a nested sleeve preventing fluid communication between the interior of the tool and the exterior of the tool is provided. The downhole tool is actuated when fluid pressure is communicated from the interior of the tool to a first surface the nested sleeve, moving the nested sleeve such that it no longer prevents fluid communication from the interior to the exterior. Devices and methods for controlling the flow of fluid to the first surface of the nested sleeve are provided including fluid control devices such as burst disks, indexing sleeves and ratchet assemblies. In certain embodiments, the nested sleeve may be engaged with a slot system such that the nested sleeve moves along a path defined by such slot until the tool is actuated.

14 Claims, 32 Drawing Sheets

(56) References Cited

U.S. PATENT DOCUMENTS

| | | | | |
|---|---|---|---|---|
| 2009/0095486 | A1* | 4/2009 | Williamson, Jr. | E21B 21/103 166/373 |
| 2010/0314562 | A1* | 12/2010 | Bisset | E21B 34/06 251/12 |
| 2011/0100643 | A1* | 5/2011 | Themig | E21B 34/102 166/373 |
| 2013/0056220 | A1* | 3/2013 | Sommers | E21B 34/102 166/373 |
| 2014/0251636 | A1* | 9/2014 | Hofman | E21B 34/063 166/373 |
| 2014/0345705 | A1* | 11/2014 | Grande | E21B 23/006 137/68.17 |
| 2015/0369007 | A1* | 12/2015 | George | E21B 34/108 166/305.1 |

* cited by examiner

DOWNHOLE TOOLS, SYSTEMS AND METHODS OF USING

CROSS-REFERENCES TO RELATED APPLICATIONS

This application is a continuation in part of U.S. patent application Ser. No. 14/086,900, entitled "Downhole Tool", which claims the benefit of U.S. Provisional Application Ser. No. 61/729,264, filed Nov. 21, 2012, entitled "Downhole Tool," each of which is incorporated by reference herein.

STATEMENT REGARDING FEDERALLY SPONSORED RESEARCH OR DEVELOPMENT

Not applicable.

BACKGROUND

1. Field of the Invention

The described embodiments and invention as claimed relate to oil and natural gas production. More specifically, the invention as claimed relates to a downhole tool used to selectively activate in response to fluid pressure.

2. Description of the Related Art

In completion of oil and gas wells, tubing is often inserted into the well to function as a flow path for treating fluids into the well and for production of hydrocarbons from the well. Such tubing may help preserve casing integrity, optimize production, or serve other purposes. Such tubing may be described or labeled as casing, production tubing, liners, tubulars, or other terms. The term "tubing" as used in this disclosure and the claims is not limited to any particular type, shape, size or installation of tubular goods.

To fulfill these purposes, the tubing must maintain structural integrity against the pressures and pressure cycles it will encounter during its functional life. To test this integrity, operators will install the tubing with a closed "toe"—the end of the tubing furthest from the wellhead—and then subject the tubing to a series of pressure tests. These tests are designed to demonstrate whether the tubing will hold the pressures which it will experience during use.

One detriment to these pressure tests is the necessity for a closed toe. After pressure testing, the toe must be opened to allow for free flow of fluids through the tubing so that further operations may take place. While formation characteristics, cement, or other factors may still restrict fluid flow, the presence of such factors do not alleviate the desirability or necessity for opening the toe of the tubing. Commonly, the toe is opened by positioning a perforating device in the toe and either explosively or abrasively perforating the tubing to create one or more openings. Perforating, however, requires additional time and equipment that increase the cost of the well.

Furthermore, current methods of opening the toe with hydraulic pressure limit the pressure test to pressures below the highest pressure the tubing will experience, to a maximum period of time, to a single test, or some combination of the above. This is particularly true in cemented environments where the inside of the tool is exposed to a cement slurry that contains particulate solids and which will ultimately harden.

Therefore, there exists a need for an improved method of opening the toe of the tubing after it is installed and pressure tested. The present disclosure describes improved devices and methods for opening the toe of tubing installed in a well. Some embodiment tools according to the present disclosure allow the pressure test to be conducted at the full burst pressure rating of the device, and allow sequential pressure tests to be performed. The devices and methods may also be readily adapted to other locations in the well and for other use in tools other than toe valves.

SUMMARY

The described embodiments of the present disclosure address the problems associated with the closed toe required for pressure testing tubing installed in a well. Further, in one aspect of the present disclosure, a chamber, such as a pressure chamber, air chamber, or atmospheric chamber, is in fluid communication with at least one surface of the shifting element of the device. The chamber is isolated from the interior of the tubing such that fluid pressure inside the tubing is not transferred to the chamber. A second surface of the shifting element is in fluid communication with the interior of the tubing. Application of fluid pressure on the interior of the tubing thereby creates a pressure differential across the shifting element, applying force tending to shift the shifting element in the direction of the pressure chamber, atmospheric chamber, or air chamber.

In a further aspect of the present disclosure, the shifting element is encased in an enclosure such that all surfaces of the shifting element opposing the chamber are isolated from the fluid, and fluid pressure, in the interior of the tubing. Upon occurrence of some predetermined event—such as a minimum fluid pressure, the presence of acid, or electromagnetic signal—at least one surface of the shifting element is exposed to the fluid pressure from the interior of the tubing, creating differential pressure thereacross. Specifically, the pressure differential is created relative to the pressure in the chamber, and applies a net force on the shifting element in a desired direction. Such force activates the tool.

While specific predetermined events are stated above, any event or signal communicable to the device may be used to expose at least one surface of the shifting element to pressure from the interior of the tubing.

In a further aspect, the downhole tool comprises an inner sleeve with a plurality of sleeve ports. A housing is positioned radially outwardly of the inner sleeve, with the housing and inner sleeve partially defining a space radially therebetween. The space, which is preferably annular, is occupied by a shifting element, which may be a shifting sleeve. A fluid path extends between the interior flowpath of the tool and the space. A fluid control device, which is preferably a burst disk, occupies at least a portion of the fluid path.

When the toe is closed, the shifting sleeve is in a first position between the housing ports and the sleeve ports to prevent fluid flow between the interior flowpath and exterior of the tool. A control member is installed to prevent or limit movement of the shifting sleeve until a predetermined internal tubing pressure or internal flowpath pressure is reached. Such member may be a fluid control device which selectively permits fluid flow, and thus pressure communication, into the annular space to cause a differential pressure across the shifting sleeve. Any device, including, without limitation, shear pins, springs, and seals, may be used provided such device allows movement of the shifting element, such as shifting sleeve, only after a predetermined internal tubing pressure or other predetermined event occurs. In a preferred embodiment, the fluid control device will permit fluid flow into the annular space only after it is exposed to a predetermined differential pressure. When this differential pressure is reached, the fluid control device allows fluid flow, the shifting sleeve is moved to a second position, the toe is opened, and communication may occur through the housing and sleeve ports between the interior flowpath and exterior flowpath of the tool.

In a further aspect of the present disclosure, an alternative embodiment nested sleeve assembly may comprise a fluid control device that is a separate nested sleeve blocking the fluid passageway to the upper pressure chamber, also referred to as the inlet chamber. This second nested sleeve functions as a trigger sleeve because movement of the trigger sleeve to its open position permits fluid flow to the inlet chamber and thereby permits actuation of the sliding sleeve. Further, the trigger sleeve may be connected directly to an indexing assembly such that the trigger sleeve only moves to the open position after a desired number of pressure cycles, permitting fluid flow to the shifting sleeve so that the necessary pressure differential across the shifting sleeve may be created in order to open the shifting sleeve.

In a further aspect of the present disclosure, alternative indexing assemblies are disclosed. A ratcheting indexing assembly may be used such that increased fluid pressure, acting on a pressure sleeve or piston, advances a ratchet assembly in communication with a trigger element. An opposing force, which may be a spring, causes the piston to move in the opposite direction, retracting the ratchet assembly. When the ratchet assembly has moved a necessary distance through the passage of a plurality of cycles, the trigger element is actuated.

DETAILED DESCRIPTION OF VARIOUS EMBODIMENTS

When used with reference to the figures, unless otherwise specified, the terms "upwell," "above," "top," "upper," "downwell," "below," "bottom," "lower," and like terms are used relative to the direction of normal production and/or flow of fluids and or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during the fracing process, fracing fluids and/or gasses move from the surface in the downwell direction to the portion of the tubing string within the formation.

Figure 1:
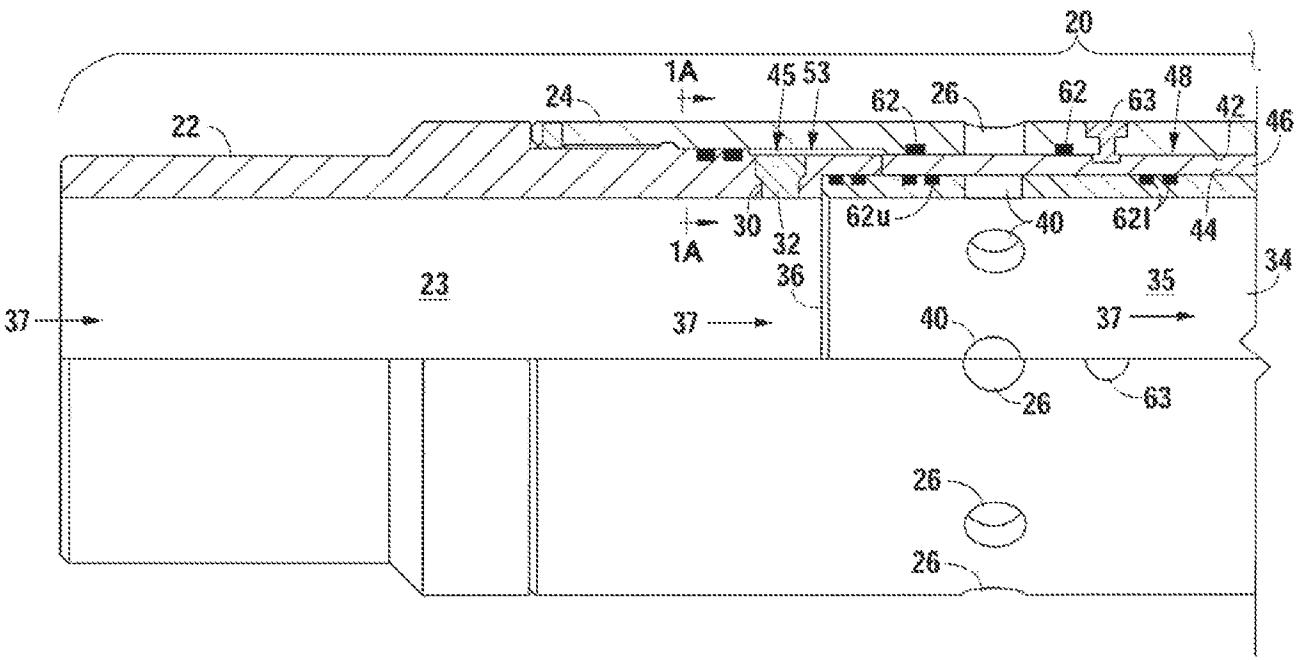
FIGS. 1-2 are partial sectional side elevations of an embodiment in the closed position.
Figure 1A:
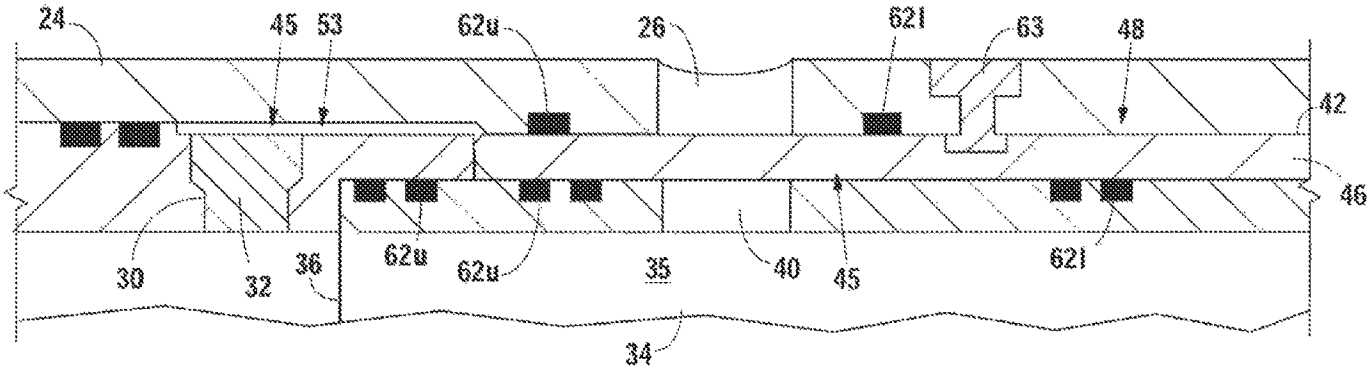
FIGS. 1A & 2A are enlarged views of sections of FIGS. 1 & 2 respectively.
Figure 2:
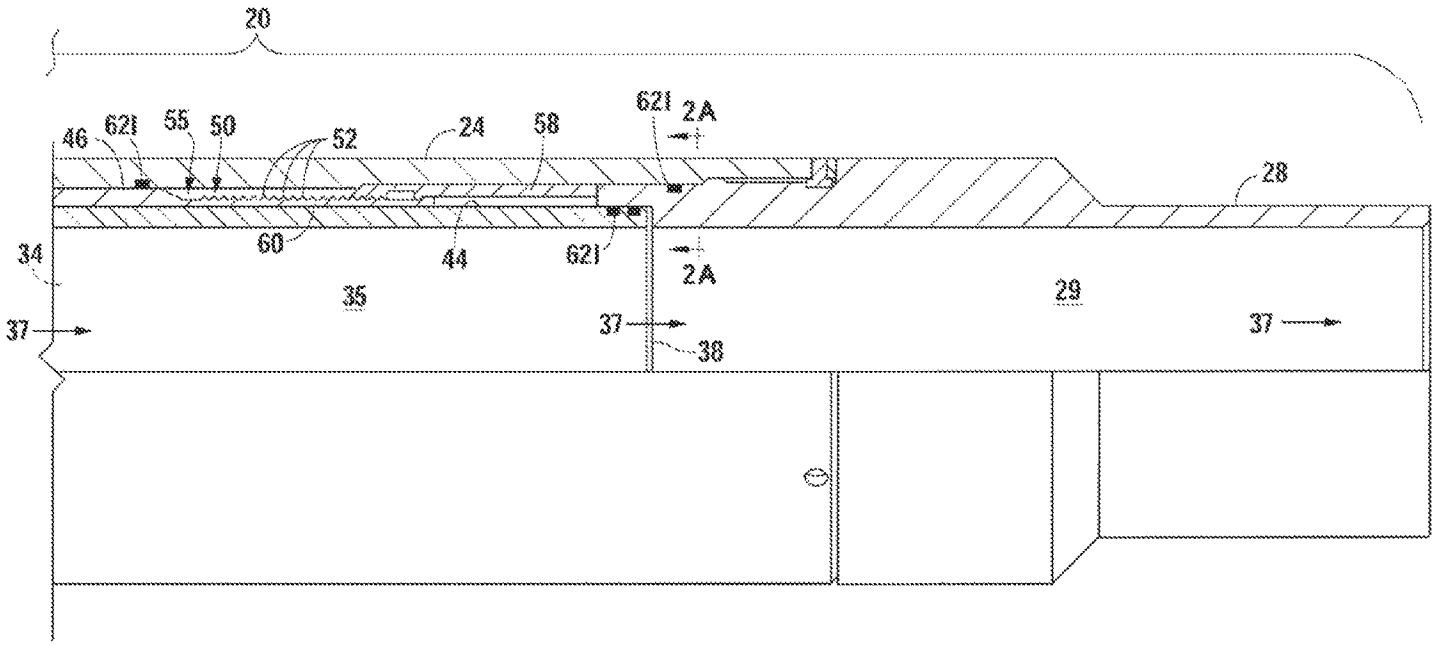
Figure 2A:
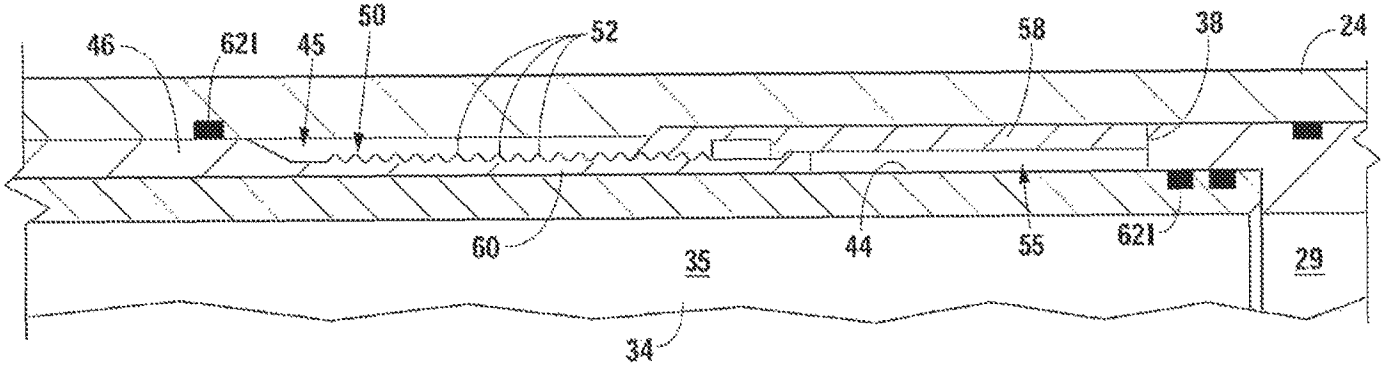

FIGS. 1-2 depict an embodiment 20, which comprises a top connection 22 threaded to a top end of ported housing 24 having a plurality of radially-aligned housing ports 26. A bottom connection 28 is threaded to the bottom end of the ported housing 24. The top and bottom connections 22, 28 have cylindrical inner surfaces 23, 29, respectively. A fluid path 30 through the wall of the top connection 22 is filled with a burst disk 32 having a rated pressure that will rupture when a pressure is applied to the interior of the tool 22 that exceeds the rated pressure.

The embodiment 20 includes an inner sleeve 34 having a cylindrical inner surface 35 positioned between a lower annular shoulder surface 36 of the top connection 22 and an upper annular shoulder surface 38 of the bottom connection 28. The inner sleeve 34 has a plurality of radially aligned sleeve ports 40. Each of the sleeve ports 40 is axially aligned with a corresponding housing port 26. The inner surfaces 23, 29 of the top and bottom connections 22, 28 and the inner surface 35 of the sleeve 34 define an interior flowpath 37 for the movement of fluids into, out of, and through the tool. In an alternative embodiment, the interior flowpath 37 may be defined, in whole or in part, by the inner surface of the shifting sleeve.

Although the housing ports 26 and sleeve ports 40 are shown as cylindrical channels between the exterior and interior of the tool 20, the ports 26, 40 may be of any shape sufficient to facilitate the flow of fluid therethrough for the specific application of the tool. For example, larger ports may be used to increase flow volumes, while smaller ports may be used to reduce cement contact in cemented applications. Moreover, while preferably axially aligned, each of the sleeve ports 40 need not be axially aligned with its corresponding housing port 26.

The top connection 22, the bottom connection 28, an interior surface 42 of the ported housing 24, and an exterior surface 44 of the inner sleeve 34 define an annular space 45, which is partially occupied by a shifting sleeve 46 having an upper portion 48 and a lower locking portion 50 having a plurality of radially-outwardly oriented locking dogs 52. Upper sealing elements 62*u* and lower sealing elements 62*l* provide pressure isolation between the inner sleeve 34 and the shifting sleeve. In an alternative embodiment, the interior flowpath 37 may be defined, in whole or in part, by the inner surface of the shifting sleeve 46.

The annular space 45 comprises an upper pressure chamber 53—which may also be called an inlet pressure chamber—defined by the top connection 22, burst disk 32, outer housing 24, inner sleeve 34, shifting sleeve 46, and upper sealing elements 62*u*. The annular space 45 further comprises a lower pressure chamber 55 defined by the bottom connection 28, the ported housing 24, the inner sleeve 34, the shifting sleeve 46, and lower sealing elements 62*l*. In one embodiment, the pressure within the upper and lower pressure chambers 53, 55 is atmospheric when the tool is installed in a well (i.e., the burst disk 32 is intact).

A locking member 58 partially occupies the annular space 45 below the shifting sleeve 46 and ported housing 24. When the shifting sleeve 46 is shifted as described hereafter, the locking dogs 52 engage the locking member 58 and inhibit movement of the shifting sleeve 46 toward the shifting sleeve's first position.

The shifting sleeve 46 is moveable within the annular space 45 between a first position and a second position by application of hydraulic pressure to the tool 20. When the shifting sleeve 46 is in the first position, which is shown in FIGS. 1-2, fluid flow from the interior to the exterior of the tool through the housing ports 26 and sleeve ports 40 is impeded by the shifting sleeve 46 and surrounding sealing elements 62. Shear pins 63 may extend through the ported housing 24 and engage the shifting sleeve 46 to prevent unintended movement toward the second position, such as during installation of the tool 20 into the well. Although shear pins 63 function in such a manner as a secondary safety device, alternative embodiments contemplate operation without the shear pins 63. For example, the downhole tool may be installed with the lower pressure chamber 55 containing fluid at a higher pressure than the upper pressure chamber 53, which would tend to move and hold the shifting sleeve in the direction of the upper pressure chamber.

To shift the sleeve 46 to the second position (shown in FIG. 3-4), a pressure greater than the rated pressure of the burst disk 32 is applied to the interior (i.e., flowpath 37) of the tool 20, which may be done using conventional techniques known in the art. This causes the burst disk 32 to rupture and allows fluid to flow through the fluid path 30 to the annular space 45. In some embodiments, the pressure rating of the burst disk 32 may be lowered by subjecting the burst disk 32 to multiple pressure cycles. Thus, the burst disk 32 may ultimately be ruptured by a pressure which is lower than the burst disk's 32 initial pressure rating.

Figure 3:
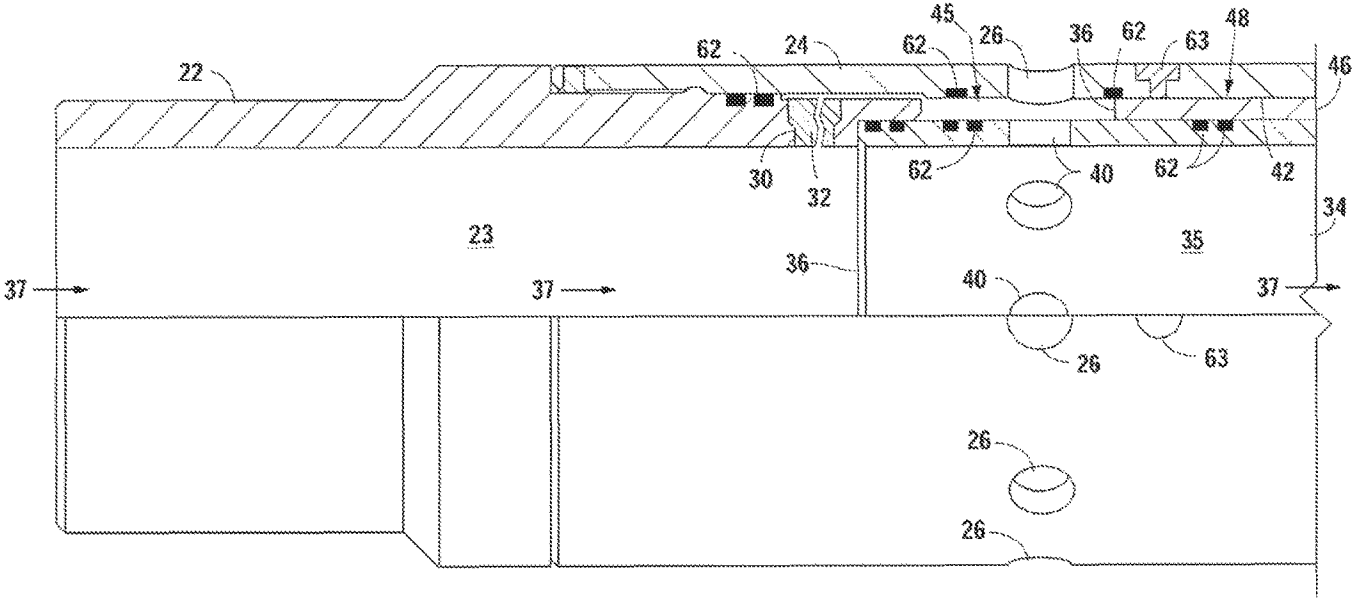
FIGS. 3-4 are partial sectional side elevations of an embodiment in the open position.
Figure 4:
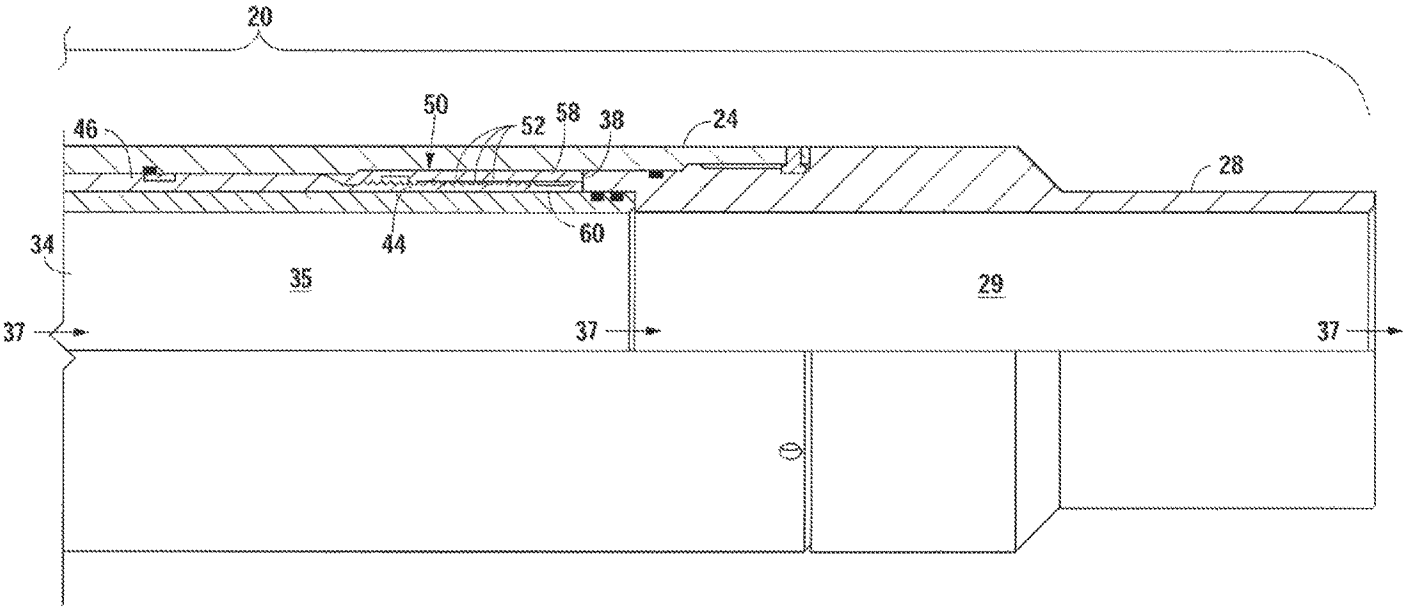

Following rupture of the burst disk 32, the shifting sleeve 46 is no longer isolated from the fluid flowing through the inner sleeve 34. The resultant increased pressure on the shifting sleeve 46 surfaces in fluid communication with the upper pressure chamber 53 creates a pressure differential relative to the atmospheric pressure within the lower pressure chamber 55. Such pressure differential across the shifting sleeve causes the shifting sleeve 46 to move from the first position to the second position shown in FIG. 3-4, provided the force applied from the pressure differential is sufficient to overcome the shear pins 63, if present. In the second position, the shifting sleeve 46 does not impede fluid flow through the housing ports 26 and sleeve ports 40, thus allowing fluid flow between the interior flow path 37 and the exterior of the tool. As the shifting sleeve 46 moves to the second position, the locking member 58 engages the locking dogs 52 to prevent subsequent upwell movement of the sleeve 46.

The arrangement of a housing with an inner sleeve therein and shifting sleeve between the housing and inner sleeve may be referred to as a nested sleeve assembly. In some embodiments, the shifting sleeve 46 of a nested sleeve assembly has pressure surfaces, such as the opposing ends of the shifting sleeve 46, isolated from the interior flowpath 37 and any fluid or fluid pressure therein. A fluid control device, such as a burst disk 32 disposed in a fluid path 30 from the interior flowpath 37 to the annular space 45, or other mechanism may be included to allow fluid communication between the interior flowpath and at least one of the pressure surfaces.

The downhole tool may be placed in positions other than the toe of the tubing, provided that sufficient internal flowpath pressure can be applied at a desired point in time to create the necessary pressure differential on the shifting sleeve. In certain embodiments, the internal flowpath pressure must be sufficient to rupture the burst disk, shear the shear pin, or otherwise overcome a pressure sensitive control element. However, other control devices not responsive to pressure may be desirable for the present device when not installed in the toe.

The downhole tool as described may be adapted to activate tools associated with the tubing rather than to open a flow path from the interior to the exterior of the tubing. Such associated tools may include a mechanical or electrical device that signals or otherwise indicates that the burst disk or other flow control device has been breached. Such a device may be useful to indicate the pressures a tubing string experiences at a particular point or points along its length. In other embodiments, the device may, when activated, trigger release of one section of tubing from the adjacent section of tubing or tool. For example, the shifting element may be configured to mechanically release a latch holding two sections of tubing together. Any other tool may be used in conjunction with, or as part of, the tool of the present disclosure provided that the inner member selectively moves within the space in response to fluid flow through the flowpath. Numerous such alternate uses will be readily apparent to those who design and use tools for oil and gas wells.

Figure 5A:
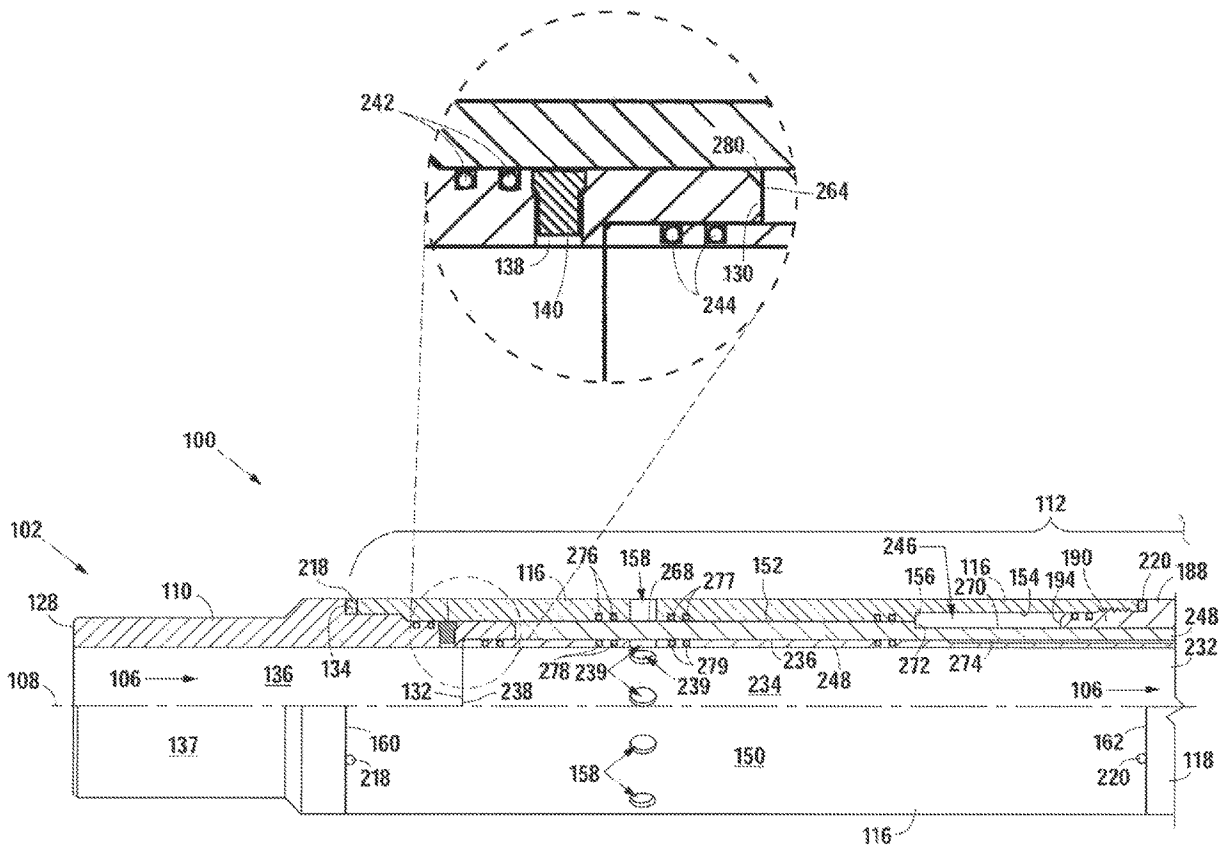
FIGS. 5A-5C are partial sectional side elevations that collectively show a second embodiment of the tool in the closed position.
Figure 5B:
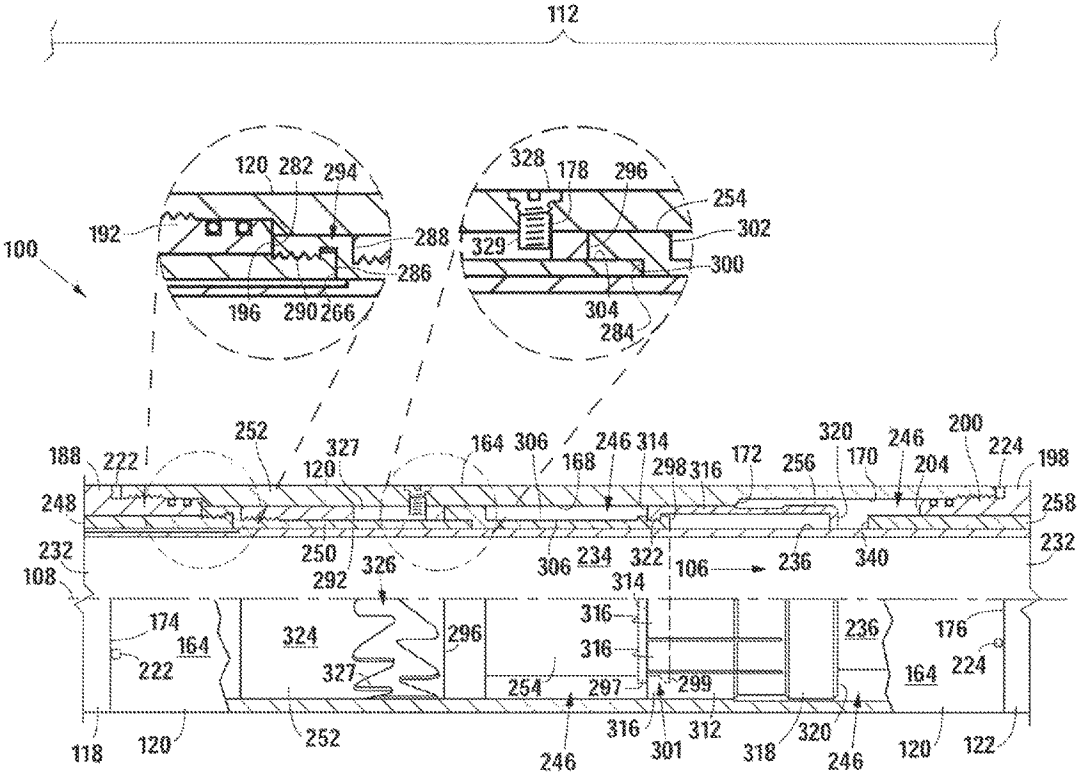
Figure 5C:
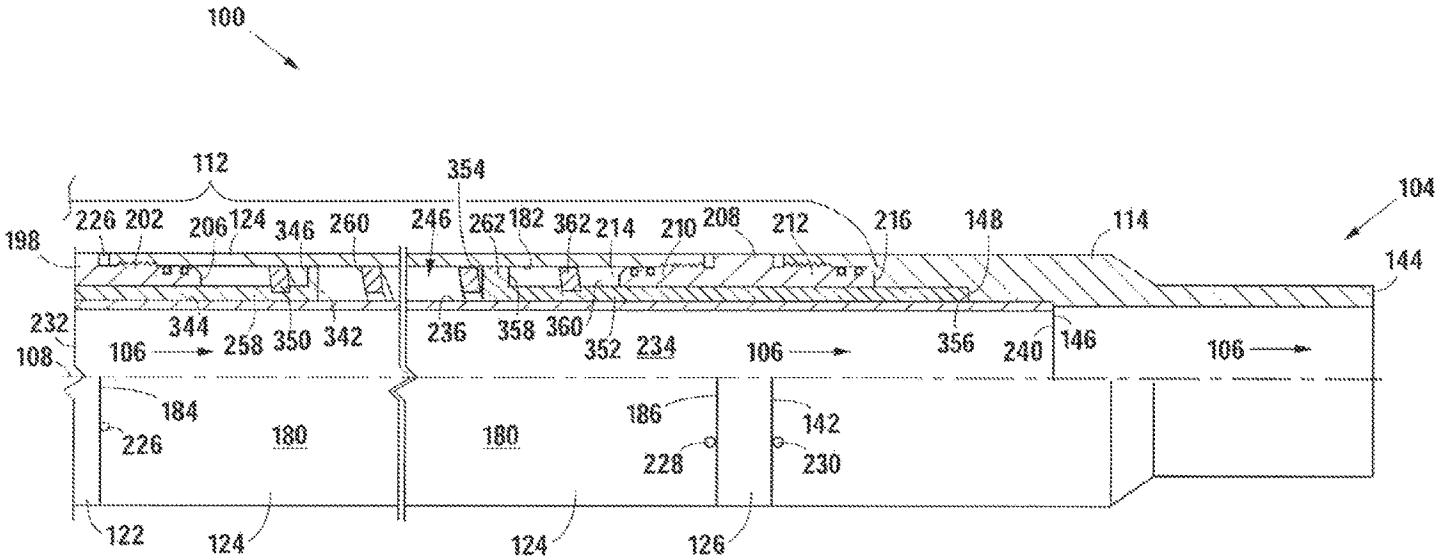

FIGS. 5A-5C together show an alternative embodiment 100 having a first end 102, a second end 104, and a cylindrical flowpath 106 having a longitudinal axis 108 extending between the first end 102 and the second end 104. While the flowpath 106 through the embodiment 100 provides access to the tool exterior at the first end 102 and second end 104, the flowpath 106 is radially separated, relative to the axis 108, from the exterior by a top connection 110, a housing assembly 112, and a bottom connection 114. The housing assembly 112 comprises a ported housing 116, a first housing connector 118, a collet housing 120, a second housing connector 122, a spring housing 124, and a third housing connector 126. Each of the ported housing 116, collet housing 120, and spring housing 124 is a tubular body.

Referring specifically to FIG. 5A, the top connection 110 has a first annular end surface 128, a second annular end surface 130, and first and second annular shoulder surfaces 132, 134 longitudinally positioned between the first and second annular end surfaces 128, 130. The top connection 110 further has a cylindrical inner surface 136 adjacent the first end surface 128, a first shoulder surface 132 that defines a portion of the flowpath 106, and an outer surface 137 adjacent the first end surface 128 and second end surface 130. A fluid path 138 extends radially from the inner surface 136 to the outer surface 137. The fluid path 138 is occupied with a fluid control device, such as a burst disk 140, that will rupture when a pressure is applied to the flowpath 106 that exceeds a rated pressure.

The ported housing 116 has a cylindrical outer surface 150, a cylindrical first inner surface 152, a cylindrical second inner surface 154, an annular shoulder surface 156 separating the first inner surface 152 and the second inner surface 154, and a plurality of circumferentially-aligned, radially-oriented housing ports 158 extending between the outer surface 150 and the first inner surface 152. The ported housing 116 further has first and second annular end surfaces 160, 162 adjacent to the outer surface 150. The first end surface 160 is adjacent to the first inner surface 152, and the second end surface 162 is adjacent to the second inner surface 154.

Referring to FIG. 5B, the collet housing 120 has an outer cylindrical surface 164, a cylindrical first inner surface 168, a cylindrical second inner surface 170, a partially-conical shoulder surface 172 separating the first and second inner surfaces 168, 170, and first and second annular end surfaces 174, 176. The diameter of the first inner surface 168 is less than the diameter of the second inner surface 170. A pin hole 178 extends through the collet housing 120 between the first inner surface 168 and the outer surface 164.

Referring to FIG. 5C, the spring housing 124 has a cylindrical outer surface 180, a cylindrical inner surface 182, and first and second annular end surfaces 184, 186 adjacent to the outer and inner surfaces 180, 182. The bottom connection 114 has a first annular end surface 142, a second annular end surface 144, and first and second annular shoulder surfaces 146, 148 longitudinally positioned between the first and second annular end surfaces 184, 186.

Each of the first housing connector 118, second housing connector 122, and third housing connector 126 are identically constructed. As shown in FIG. 5A-5B, the first housing connector 118 has an annular body portion 188 and first and second annular ends 190, 192 extending away from the body portion 188 terminating in first and second annular end surfaces 194, 196, respectively. As shown in FIG. 5B-5C, the second housing adaptor 122 has an annular body portion 198 and first and second annular ends 200, 202 extending away from the body portion 198 and terminating in first and second annular end surfaces 204, 206, respectively. As shown in FIG. 5C, the third housing adaptor 126 has a body portion 208 and first and second annular ends 210, 212 extending away from the body portion 208 and terminating in first and second annular end surfaces 214, 216, respectively.

Referring back to FIG. 5A, the ported housing 116 is fixed to the top connection 110 with a first set of circumferentially aligned screws 218 and to the first end 190 of the first housing connector 118 with a second set of circumferentially aligned screws 220. As shown in FIG. 5B, the collet housing 120 is connected to the second end 192 of the first housing connector 118 with a third set of circumferentially aligned screws 222 and the first end 200 of the second housing connecter 122 with a fourth set of circumferentially aligned screws 224. As shown in FIG. 5C, the spring housing 124 is connected to a second end 202 of the second housing connector 122 with a fifth set of circumferentially-aligned screws 226 and to the first end 210 of the third housing connector 126 with a sixth set of circumferentially-aligned screws 228. The bottom connection 114 is connected to the second end 212 of the third housing connector 126 with a seventh set of circumferentially aligned screws 230.

Referring again collectively to FIGS. 5A-5C, an inner sleeve 232 is longitudinally fixed between, and relative to, the top connection 110 and the bottom connection 114. The inner sleeve 232 has a cylindrical inner surface 234 that defines a portion of the flowpath 106, a cylindrical outer surface 236, and first and second annular end surfaces 238, 240. The first annular end surface 238 is positioned adjacent to the first shoulder surface 132 of the top connection 110. The second end surface 240 is positioned adjacent to the first shoulder surface 146 of the bottom connection 114. The inner sleeve 232 has a plurality of radially-aligned sleeve ports 239 extending between inner surface 234 and the outer surface 236. Each of the sleeve ports 239 is axially aligned with a corresponding housing port 158 of the ported housing 116.

Annular sealing elements 242 are positioned radially between the top connection 110 and the ported housing 116. Annular sealing elements 244 are positioned radially between the inner sleeve 232 and the top connection 110.

The top connection 110, housing assembly 112, inner sleeve 232 and bottom connection 114 together define an annular space 246 radially positioned relative to the longitudinal axis 108 between the flowpath 106 and the exterior of the embodiment 100. The annular space 246 is occupied by a shifting sleeve 248, a bearing sleeve 250, a slotted member 252, a collet retainer 254, a collet 256, a first spring bearing 258, a coil spring 260, and a second spring bearing 262.

Referring specifically to FIG. 5A, the shifting sleeve 248 is a tubular body coaxially aligned with the inner sleeve 232 around the longitudinal axis 108. The shifting sleeve 248 has a first annular end surface 264, a second annular end surface 266 (see FIG. 5B), a first outer surface 268 having a first diameter, a second outer surface 270 having a second diameter less than the first diameter, an annular shoulder surface 272 separating the first and second outer surfaces 268, 270, and a cylindrical inner surface 274. The inner surface 274 is closely fitted to the outer surface 236 of the inner sleeve 232. The first end surface 264 is adjacent to the second end surface 130 of the top connection 110. Annular sealing elements 276, 277 are positioned radially between the shifting sleeve 248 and the ported housing 116 on either side of the housing ports 158. Annular sealing elements 278, 279 are positioned radially between the shifting sleeve 248 and the inner sleeve 232 on either side of the sleeve ports 239.

An annular chamber 280 intersects with the annular space 246 and the fluid path 138. As shown in FIG. 5A, the chamber 280 is the space defined by the top connection 110, sealing elements 242, 244, 276, 278, the burst disk 140, inner sleeve 232, and the shifting sleeve 248.

Referring to FIG. 5B, the second end surface 266 of the shifting sleeve 248 is adjacent to the bearing sleeve 250, which has a first annular end surface 282 and a second annular end surface 284, an inner shoulder surface 286, and an outer shoulder surface 288. The inner shoulder surface 286 is adjacent to and separates first and second cylindrical inner surfaces 290, 292, of the bearing sleeve 250. The second inner surface 292 is closely fitted to the outer surface 236 of the inner sleeve 232. The first inner surface 290 has a larger diameter than the second inner surface 292 and defines, with the adjacent portion of the inner sleeve 232, an annular space 294 in which the second end surface 266 of the shifting sleeve 248 contacts the inner shoulder surface 286. The first annular end surface 282 is in contact with the second end surface 196 of the first housing connector 118.

The second annular end surface 284 of the bearing sleeve 250 is fitted to the collet retainer 254. The collet retainer 254 has a first annular end surface 296 and a second annular end surface 298, an inner shoulder surface 300, and an outer shoulder surface 302. The inner shoulder surface 300 is adjacent to and separates first and second inner cylindrical surfaces 304, 306. The second inner surface 306 is closely fitted to the outer surface 236 of the inner sleeve 232. The first inner surface 304 has a larger diameter than the second inner surface 306 and, with the adjacent portion of the inner sleeve 236, defines an annular space into which the second end surface 284 of the bearing sleeve 250 is fitted and contacts the inner shoulder surface 300.

First and second annular retaining members 297, 299 define a circumferential retaining groove 301 proximal to the second end surface 298 of the collet retainer 254. The second retainer member 299 coterminates with the second end surface 298 of the collet retainer 254.

The collet 312 is positioned around the second end surface 298 of the collet retainer 254. The collet 312 has a first end 314 coterminating with the ends of collet fingers 316, an annular body 318, and an annular end surface 320 opposing the first end 314. Each collet finger 316 extends from the annular body 318 toward the outer shoulder surface 302 of the retainer 254 and terminates in an inwardly-extending shoulder 322 that coterminates with the first end 314. The fingers 316 are in contact with, and inhibited from radial expansion away from the retainer 254 by, the first inner surface 168 of the collet housing 120. The inwardly-extending shoulder 322 is positioned in the retaining groove 301 defined by the collet retainer 254.

The annular slotted member 252 is positioned around the bearing sleeve 250 and longitudinally between the outer shoulder surface 288 of the bearing sleeve 250 and the first end surface 296 of the collet retainer 254. The slotted member 252 has an outer surface 324 and a slot 326 formed in the outer surface 324. A pin, such as torque pin 328, extends through the pin hole 178 in the collet housing 120 and has a terminal end 329 positioned in the slot 326. The slotted member 252 is concentrically aligned with the axis 108.

Figure 6A:
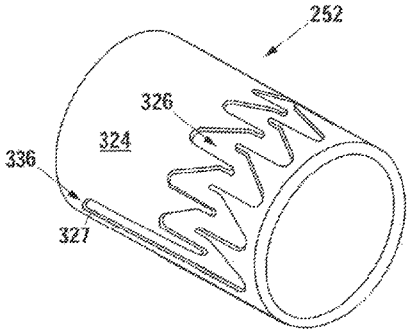
FIGS. 6A-6B show features of the slotted member of the second embodiment.
Figure 6B:
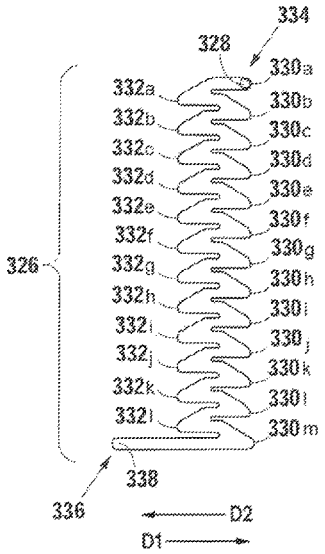

As shown in FIG. 6A-6B, the slot 326 is a continuous path defined by a slot sidewall 327 and extending circumferentially around, and formed in, the outer surface 324 of the slotted member 252. The slot 326 is formed of a repeated pattern of longitudinally-aligned first positions 330*a-m* and longitudinally aligned intermediate positions 332*a-l*. A first end 334 of the slot 326 terminates in the first position 330*a*. A second end 336 of the slot 326 terminates with a second position 338. The intermediate positions 332*a-l* are longitudinally between the first positions 330*a-m* and the second position 338.

The slot 326 is shaped so that when the torque pin 328 is in one of the first positions 330*a-m* and the slotted member 252 moves in a first longitudinal direction D1 relative to the pin 328, the torque pin 328 moves toward the adjacent intermediate position. If the torque pin 328 is in the first position 330*m* and the slotted member 252 moves in the first direction D1, the pin 328 moves toward the second position 338. When the torque pin 328 is in a intermediate position, such as the intermediate position 332*a*, and the slotted member 252 moves in a second longitudinal direction D2 toward the first end 102 of the embodiment 100, the torque pin 328 moves toward the next adjacent first position, first position 330*b*.

Referring back to FIG. 5B-5C, the first spring bearing 258 has an annular first end surface 340, an annular second end surface 342, and an inner cylindrical surface 344 closely fitted to the outer surface 236 of the inner sleeve 232. The first spring bearing 258 is coaxially aligned with the inner sleeve 232. An annular shoulder surface 346 is positioned longitudinally between the first end surface 340 and the second end surface 342. As shown in FIG. 5B, a portion of the first spring bearing 258 is positioned radially between the inner sleeve 232 and the second housing connector 122 and extends past the first end surface 204 of the second housing connector 122 toward the collet 312.

As shown in FIG. 5C, the coil spring 260 is positioned in the annular space 246 longitudinally between the second housing connector 122 and the third housing connector 126, and radially between the inner sleeve 232 and the spring housing 124. The coil spring 260 has a first end 350 positioned between the second end surface 206 of the second housing connector 122 and the shoulder surface 346 of the first spring bearing 258. The first end 350 of the spring 260 is fixed to, and moves longitudinally with, the first spring bearing 258.

A second spring bearing 352 is positioned in the annular space 246, and has a first annular end surface 354 and a second annular end surface 356. An annular shoulder surface 358 is positioned between the first annular surface 354 and the second annular surface 356. The second spring bearing 352 has a cylindrical outer surface 360 positioned radially between the third housing adaptor 126 and the inner sleeve 232. The coil spring 260 has a second end 362 positioned longitudinally between the shoulder surface 358 of second spring bearing 352 and the third housing connector 126.

FIGS. 5A-5C collectively show the embodiment 100 as it may be run into a wellbore, with the second end 104 being located downwell of the first end 102. In this run-in configuration, the pressure in the chamber 280 is atmospheric and the burst disk 140 is intact. As shown in FIG. 5B, the end surface 320 of the collet 312 is spaced a distance from the first end surface 204 of second housing connector 122, and the first end 314 of the collet 312 is around a portion of the collet retainer 254. The first end 314 of the collet 312 is positioned radially within first inner surface 168 of the collet housing 120. The shoulder 322 is positioned in the retaining groove 301, resulting in the collet 312 having a fixed longitudinal relationship with the collet retainer 254. The end 329 of torque pin 328 is positioned in the slot 326 in a first position, such as the first position 330*a* (see FIG. 6). The coil spring 260 is urging the first spring bearing 258 toward the first end 102 of the embodiment 100, which in turn urges the collet 312, collet retainer 254, bearing sleeve 250, and shifting sleeve 248 toward the first end 102 of the embodiment.

As shown in FIG. 5A, the shifting sleeve 248 is moveable within the annular space 246 between a first position and a second position (as will be described with reference to FIGS. 8A-8C) by application of hydraulic pressure to the chamber 280. When the shifting sleeve 248 is in the first position, fluid flow from the flowpath 106 to the exterior of the embodiment through the housing ports 158 and sleeve ports 239 is impeded by the shifting sleeve 248 and surrounding sealing elements 276-279.

Referring to FIG. 5A, to move the shifting sleeve 248, a pressure greater than the rated pressure of the burst disk 140 is applied to the flowpath 106 to rupture burst disk 140 and establish a fluid communication path from the flow path 106 to the chamber 280 through the fluid path 138. Fluid is inhibited from exiting the chamber 280 between the various elements of the embodiment 100 by sealing elements 242, 244, 276, 278.

After the rupture of the burst disk 140, the resultant increased pressure on the first end surface 264 of the shifting sleeve 248 creates a pressure differential relative to the expansive force exerted by the coil spring 260 and the pressure in the remaining portions of the annular space 246, which causes the shifting sleeve 248 to move toward the second end 104 of the embodiment 100. Because of the longitudinally-fixed relationship of the bearing sleeve 250, slotted member 252, collet retainer 254, and collet 312 relative to the shifting sleeve 248, these elements are also moved toward the second end 104, provided the force applied from the pressure differential is sufficient to move these elements and overcome the increasing magnitude of the force resulting from increased compression of the spring 260 under Hooke's law. While the slotted member 252 is longitudinally fixed relative to the bearing sleeve 250 and the collet retainer 254, the slotted member 252 is rotatable around the bearing sleeve 250, subject to the positioning of the torque pin 328 within the slot 326.

Figure 7A:
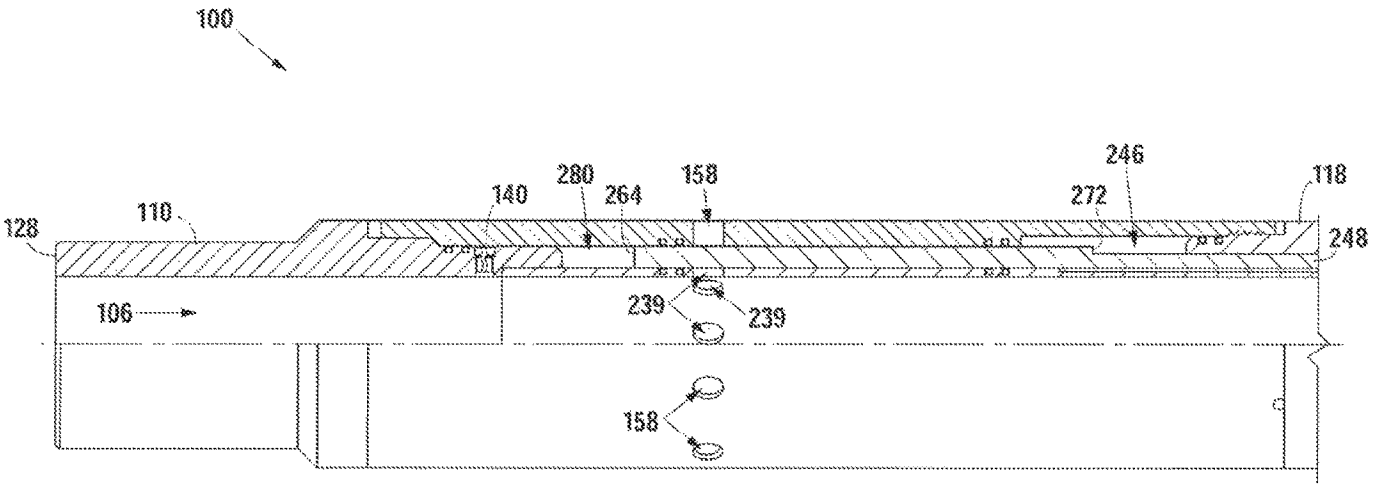
FIGS. 7A-7C are partial sectional side elevations that collectively show the second embodiment in a shifted position.
Figure 7B:
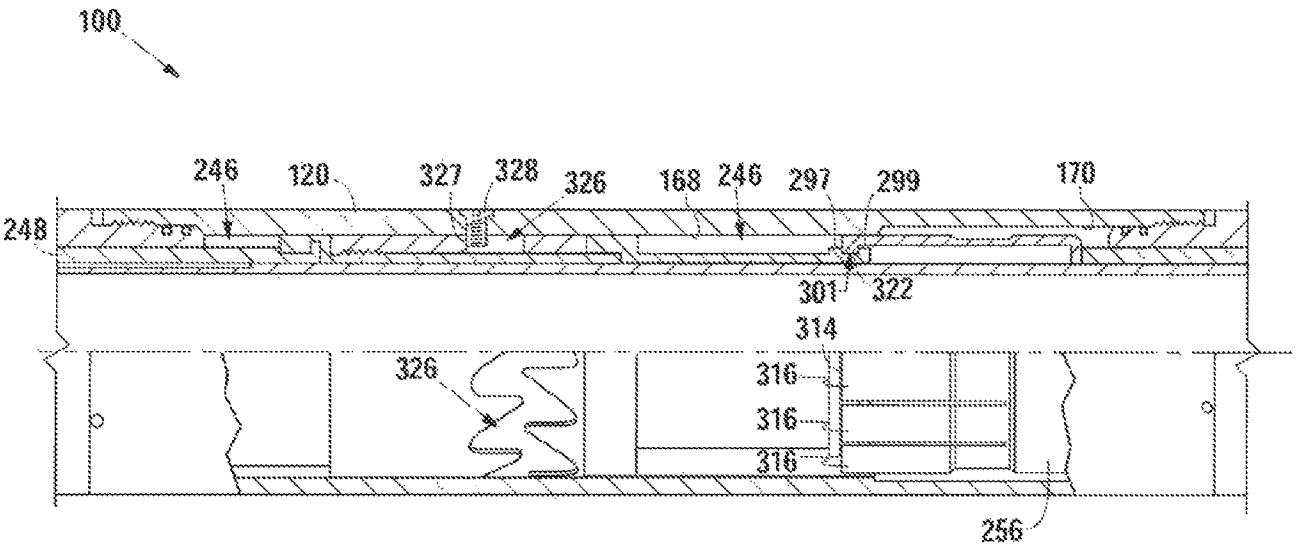
Figure 7C:
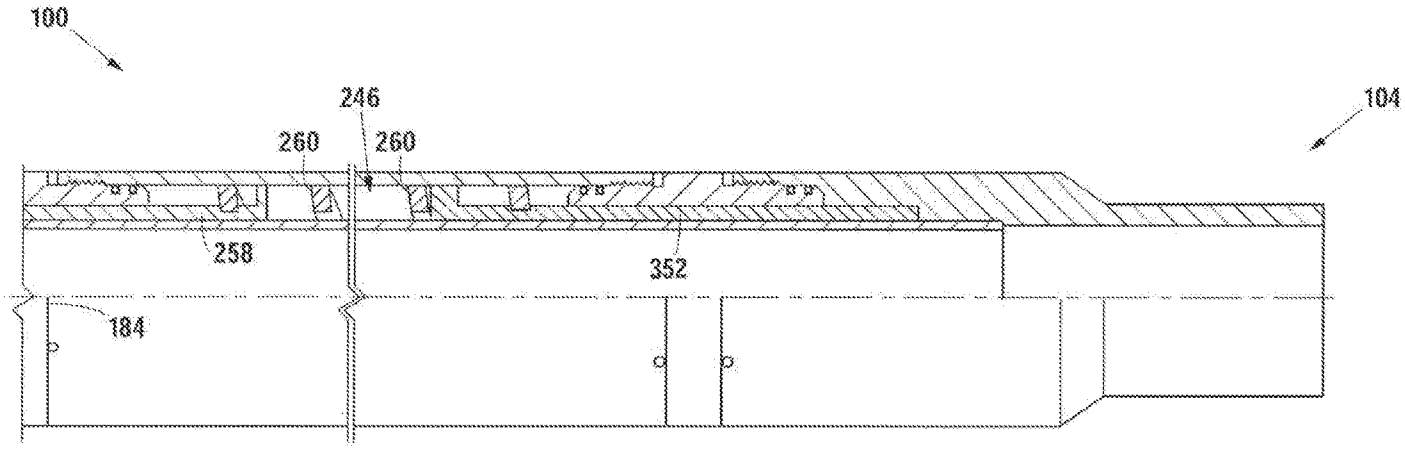

FIGS. 7A-7C collectively show the embodiment with the shifting sleeve 248 and related components in a shifted position. In this position, the torque pin 328 is in one of the first positions of the slot 326. The volume of the chamber 280 is larger than as shown in FIG. 5A because of displacement of the first end surface 264 of the shifting sleeve 248. The collet fingers 316 remain inhibited from radial expansion by the first inner surface 168 of the collet housing 120. Movement past the shifted position shown in FIG. 7A-7C is limited by, inter alia, the position of the torque pin 328 within the slot 326, which is in an intermediate position with the pin 328 in contact with the slot sidewall 327. The coil spring 260 exerts an expansive force on the first and second spring bearings 258, 352, urging the shifting sleeve 248 toward the top connection 110, but the shifting sleeve 248, slotted member 252, collet retainer 254, collet 256, bearing sleeve 250, and first spring bearing 258 are shifted towards the second end 104 into the intermediate position on slot 326 by the fluid pressure in chamber 280.

Following a pressure increase within the flowpath 106, and therefore chamber 280, sufficient to move the shifting sleeve 248 to the shifted position, the pressure may thereafter be decreased to a magnitude at which the expansive force of the spring 260 moves the first spring bearing 258, collet 312, collet retainer 254, bearing sleeve 250, and shifting sleeve 248 to the first position of FIG. 5A-5C. This decrease in pressure marks the end of the pressure cycle.

Figure 8A:
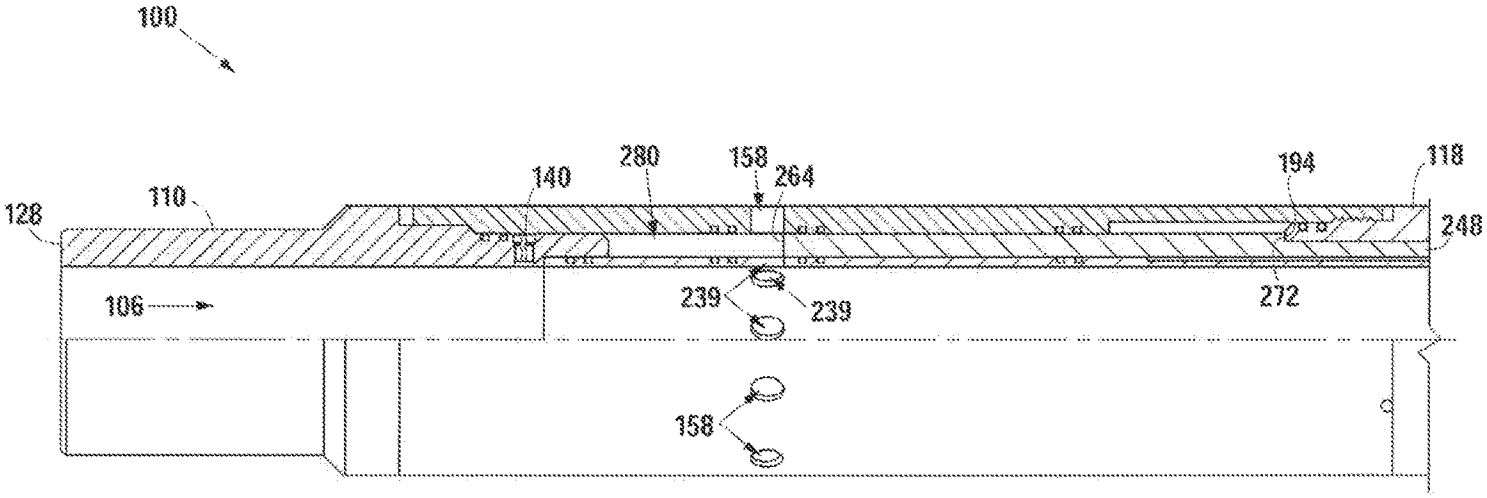
FIGS. 8A-8C are partial sectional side elevations that show the second embodiment in an open position.
Figure 8B:
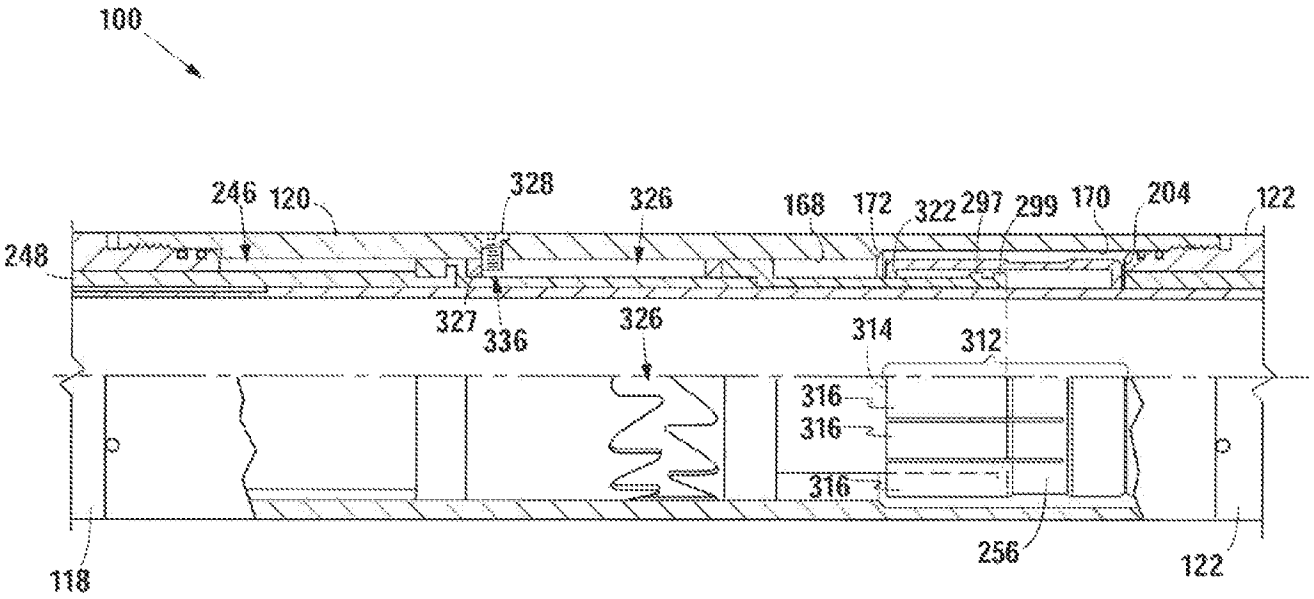
Figure 8C:
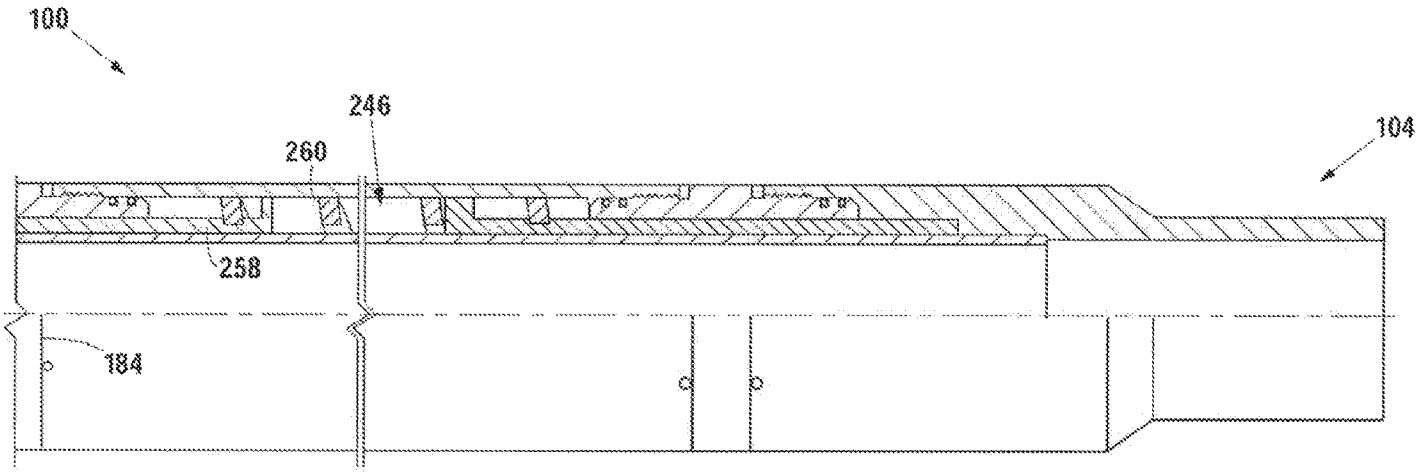

FIGS. 8A-8C collectively show the embodiment 100 with the shifting sleeve 248 and related components in the second position. As shown in FIG. 8A, the first end surface 264 of the shifting sleeve 248 is positioned longitudinally between the housing ports 158 and the first housing connector 118, which allows a fluid communication path between the exterior and the flowpath 106 through the housing ports 158, sleeve ports 239, and chamber 280. The shoulder surface 272 of the shifting sleeve 248 is adjacent to first end surface 194 of the first housing connector 118. As shown in FIG. 8B, the torque pin 328 is in the second end 336 of the slot 326. Movement of the collet 312 toward the second end 104 is limited by the first end surface 204 of the second housing connector 122. Second end 336 may be referred to as the actuated position of the slotted member. Any of the first positions 330*a-m* and the intermediate positions 332*a-l* may be referred to as a non-actuated position and any two or more collectively referred to as non-actuated positions.

The first end 314 of the collet 312 has moved past the shoulder surface 172 into the larger-diameter section defined by the second inner surface 170, which allows collet fingers 316 to radially expand as the collet retainer 254 moves further toward the second housing connector 122. This allows the retaining members 297, 299 to move past the finger shoulders 322, which terminates the fixed longitudinal relationship between the collet retainer 254 and the collet 312. Subsequent movement of the collet 312 toward the top connection 110 is inhibited by engagement of the collet fingers 316 with the shoulder surface 172. After this disengagement, the expansive force of the spring 260 is no longer translated to the shifting sleeve 248 through the collet 312 as described with reference to FIGS. 7A-7C.

One advantage of this embodiment over the embodiment described with reference to FIGS. 1-4 relates to applications in which the well operator may desire to test the tubing string at pressures near the rated pressure of the burst disk 140. Although the burst disk 140 has a rated pressure at which it is intended to rupture, it may rupture unintentionally before the rated pressure within the flowpath 106 is obtained. The closer the test pressure to the rated pressure, the more likely an unintentional rupture of the burst disk 140 that would result in a premature actuation of the embodiment shown in FIGS. 1-4, which may leave the tubing string inoperable for the intended application.

In addition, the embodiment 100 may be particularly useful for applications in which the tubing pressure will be tested multiple times prior to the desired actuation of the tool. Generally, the more frequently the burst disk 140 (or any device intended to fail at a predetermined rating) is subject to increased pressures that approach the rated pressure, the increased likelihood of failure of the burst disk 140 at a pressure lower than the rated pressure.

In either of these cases, the embodiment 100 inhibits unintended opening of the establishment of a fluid communication path and the exterior as follows. In the run-in configuration of FIG. 5A-5C, the torque pin 328 is located in a first position other than position 330*m*. Thus, it will take at least one pressure cycle, with each cycle resulting in an increase in pressure and a decrease in pressure, before the embodiment 100 will actuate, with each cycle requiring a sufficient pressure to overcome the expansive force of the spring 260 and move the shifting sleeve 248 and related elements to the position shown in FIG. 8A-8C. For example, in applications where the well operator desires to cycle pressure within the tubing string a predetermined number of cycles prior to actuation of the tool, the torque pin 328 is positioned in a corresponding first position to require at least the predetermined number of pressure cycles plus one additional pressure cycle. In this way, the slotted member 252, spring 260, and torque pin 360 function as an indexing assembly, and more specifically a mechanical and pressure responsive indexing assembly, by advancing one increment in response to the predetermined stimulus, that is the increase and decrease in fluid pressure applied the interior flowpath 106.

As a specific example, assume the burst disk 140 of the embodiment 100 has a rated burst pressure of 10,200 psi and the well operator desires to cycle the pressure to 10,000 psi three times to test the tubing string as a whole. In this scenario, the embodiment 100 is configured with the torque pin 328 positioned in the first position 330*i*. In the event the burst disk 140 does not rupture during any of the three test pressure cycles, the burst disk will rupture when intended upon application of a pressure of at least 10,200. The embodiment 100 will then be actuated to the position shown in FIG. 8A-8C with an additional four pressure cycles, with each increase in pressure causing movement of the shifting sleeve 248 to the position shown in FIG. 7A-7C and each decrease in the pressure allow the return of the shifting sleeve 248 to the position shown in FIG. 5A-5C by the coil spring 260.

If, however, the burst disk 140 inadvertently ruptures during one of the three pressure-testing cycles, the embodiment 100 prevents inadvertent movement of the shifting sleeve 248. Because the torque pin 328 is initially positioned in first position 330*i*, even if the pressure is sufficient to move the shifting sleeve 248 during one or more of the three test pressure cycles following inadvertent failure of the burst disk 140, the embodiment 100 will not actuate until at least the fourth pressure cycle.

For example, if the burst disk 140 ruptures during the first pressure test cycle and the pressure is sufficient to move the shifting sleeve 248 to the shifted position shown in FIG. 7A-7C, upon conclusion of the first pressure test cycle, the shifting sleeve 248 returns to the first position of FIG. 5A-5C as torque pin 328 advances to the next first position, which in this example is first position 330*j*. During the subsequent two pressure cycles, torque pin 328 again advances to the next first positions 330*k* and 330*l*, such that the next pressure cycle will cause the embodiment 100 to actuate to the position shown in FIG. 8A-8C.

Devices according to the present disclosure may comprise a trigger sleeve as the fluid control device. The trigger sleeve of the illustrated embodiment may be connected with an indexing assembly, such as the slotted indexing assembly of FIGS. 5-8, wherein the indexing assembly is connected to a trigger sleeve preventing fluid communication between the interior flowpath and the upper chamber until a number of pressure cycles occur. In such embodiment, the shifting sleeve remains in the first position until the tool is actuated.

Figure 9B:
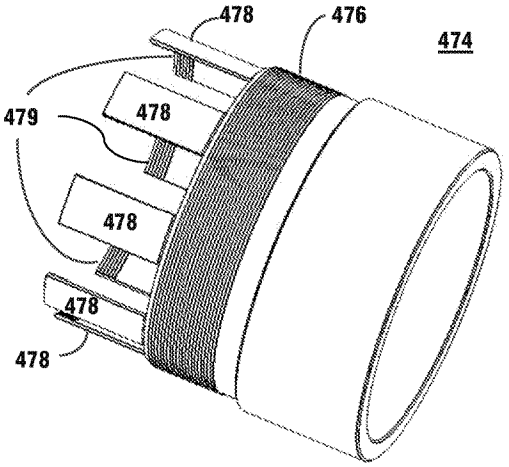
FIGS. 9A-9C are views of certain components of a nested ratchet system according to the present disclosure.
Figure 9A:
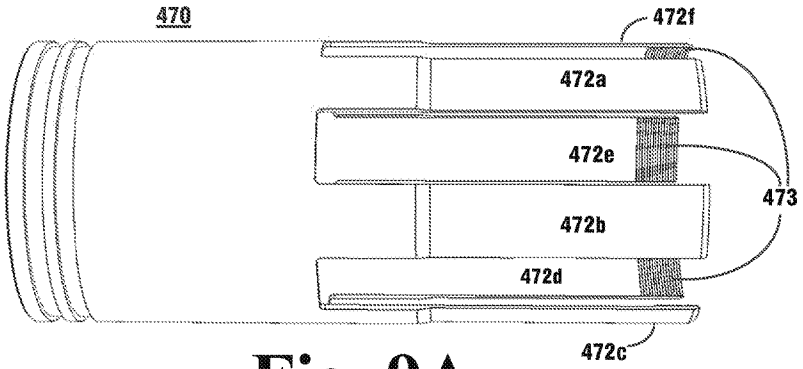
Figure 9C:
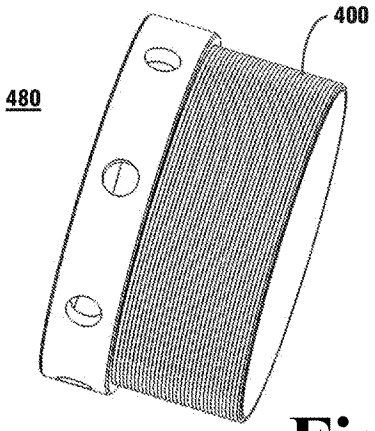
Figure 10:
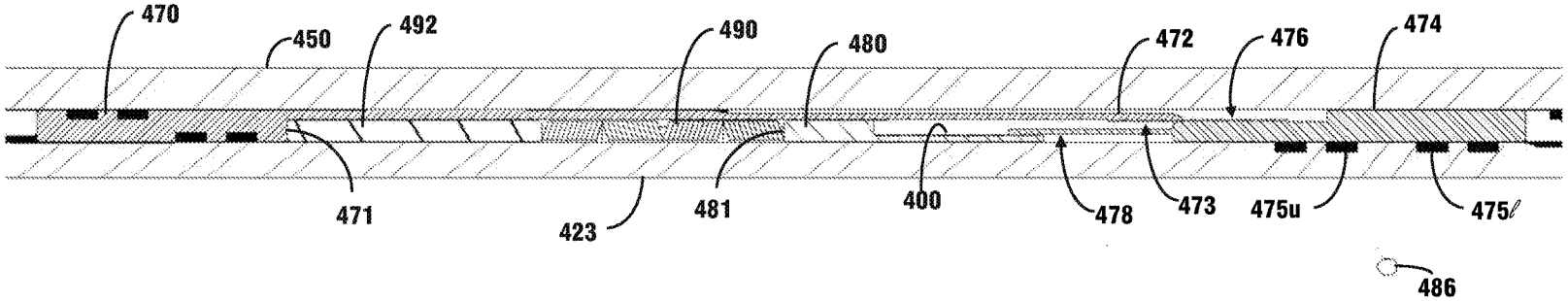
FIG. 10 is a partial side elevation of one embodiment of a telescoping nested ratchet assembly according to the present disclosure.

FIGS. 9-10 illustrate another embodiment indexing assembly comprising a ratchet and a spring. A second ratchet assembly serves as a retaining element, applying force to prevent the trigger sleeve from "backing up" during operation. The ratchets of FIGS. 9-10 are arranged such that the indexing assembly telescopes in, or compresses, as the index assembly is cycled. It will be appreciated that, although the ratcheting assembly illustrated in the figures telescopes in, ratchet assemblies that telescope out, or expand, may also be used and are within the scope of present disclosure.

Indexing assemblies according to the embodiments of FIGS. 9-10 may comprise a pressure sleeve, an indexing sleeve, and a retaining element. The components of such embodiments may be arranged in a nested fashion such that the assembly telescopes, either elongating or shortening, through each pressure cycle. FIGS. 9A, 9B, and 9C illustrate certain embodiments of such a pressure sleeve, indexing sleeve, and retaining element, respectively. As more fully described with respect to FIG. 10, the pressure sleeve, indexing sleeve, and retaining elements in FIGS. 9A-C may be assembled into an opposing nested ratchet assembly which shortens (e.g. telescopes down) a defined amount during each pressure cycle. Such an opposing nested ratchet assembly may cause or permit actuation of an associated tool when the assembly is shortened by a defined amount (e.g. when a trigger sleeve is moved a sufficient distance that it no longer prevents fluid communication through a passageway).

The pressure sleeve 470 shown in FIG. 9A comprises a collet having a body and collet fingers 472. Each collet finger has a series of pawl teeth 473 adjacent or near to its tip. The indexing sleeve 474 has a body and an indexing rack 476 comprising a series of ridges or teeth configured to engage the indexing pawl teeth 473 of the pressure sleeve 470. In the illustrated embodiment, the indexing sleeve 474 is also a collet with a series of retaining collet fingers 478 having retaining pawl teeth 479. A retaining sleeve 480 has a retaining rack 400 with teeth opposing and configured to engage retaining pawl teeth 479.

FIG. 10 shows the pressure sleeve, indexing sleeve, and retaining sleeve as they might be assembled with other components into an opposing nested ratchet assembly usable in a downhole tool. The embodiment downhole tool in FIG. 10 comprises a housing 450 and an inner sleeve 423 with an annular space therebetween. A nested ratcheting indexing assembly is positioned within the annular space and isolated from fluid inside the tool (e.g. in the interior flowpath) as well as any fluid exterior to the housing 450. The embodiment nested ratcheting assembly has a pressure sleeve 470 which engages spring stack 490 at pressure sleeve shoulder 471. Spring stack 490 engages a retaining shoulder 481 on retaining sleeve 480 such that spring stack 490 is positioned between pressure sleeve 470 and retaining sleeve 480. Collet fingers 472 pass around spring stack 490 and the retaining sleeve 480 such that indexing pawl teeth 473 are positioned adjacent to indexing rack 476 of indexing sleeve 472. Retaining collet fingers 478 of indexing sleeve 474 extend towards retaining sleeve 400 such that retaining pawl teeth 479 are positioned adjacent to retaining rack 400. The indexing pawl teeth 473 and indexing rack 476 may comprising an indexing ratchet. The retaining pawl teeth 479 and retaining rack 400 may comprise a retaining ratchet.

In the illustrated embodiment, spring spacer 492 is positioned between the spring stack 490 and pressure sleeve shoulder 471. Spring spacer 492 may be of different lengths to accommodate various lengths of spring. Such increased range of acceptable spring lengths provides greater flexibility for selecting a spring, such as spring stack 490, with a desired compression force over a selected deflection (e.g. stroke length). The spring stack illustrated in FIGS. 10-14 comprise belleville springs, which may be selected to provide the desired compression resistance over a relatively short deflection. Further, the stroke length of the belleville spring stack can be increased by placing multiple stacks of parallel belleville springs in series, e.g. opposing orientation, such as is illustrated in FIG. 10 for spring stack 490. It will be appreciated that while belleville springs may be selected for certain embodiments, springs of any type, such as helical, wave, leaf, or others may be utilized provided that the spring, as installed, applies the desired force as it compresses over the chosen deflection.

The indexing sleeve 474 of FIG. 10 functions as a fluid control device, e.g. serves a function similar to the burst disk 32 of the embodiment tool in FIG. 1. A passageway 486 through the inner sleeve 423 connects the interior flowpath of inner sleeve 423 to the annular space between the inner sleeve 423 and the housing 450. Indexing sleeve 474 is positioned in the annular space adjacent to the passageway 486 and engages seals 475*u* and 475*l* which prevent fluid communication along the radially outward surface of inner sleeve 423. Thus, indexing sleeve 474 prevents fluid and pressure communication between the passageway 486 and a tool, component or structure adjacent to passageway 486.

Details of one embodiment downhole tool with a ratcheting indexing assembly can be seen in FIGS. 11-14. The pressure sleeve 470, spring stack 490 with spacer 492, retainer sleeve 480, and indexing sleeve 474 are arranged in an annular space between inner sleeve 423 and housing 425 in the fashion described with reference to FIG. 10. With reference to FIG. 11A, first connector sub 422, which may be referred to as a "top sub" for convenience, is connected to housing 450 and abuts an end of inner sleeve 423. Housing 450 and top sub 422 form an annular space therebetween which is substantially continuous with the annular space between the inner sleeve 423 and housing 450. Adjacent to pressure sleeve 470 on the end opposite the spring stack 490 is piston 434, which is positioned in the annular space between the top sub 422 and housing 450 and extends into the annular space between the inner sleeve 423 and housing 450. A pressure surface 436 of piston 434 is fluidly connected to the interior flowpath of the tool via fluid passageway 430. Fluid passageway 430 may be occupied by a burst disk 432 which prevents fluid communication through the fluid passageway 430 until the burst disk 432 is ruptured.

Figure 11A:
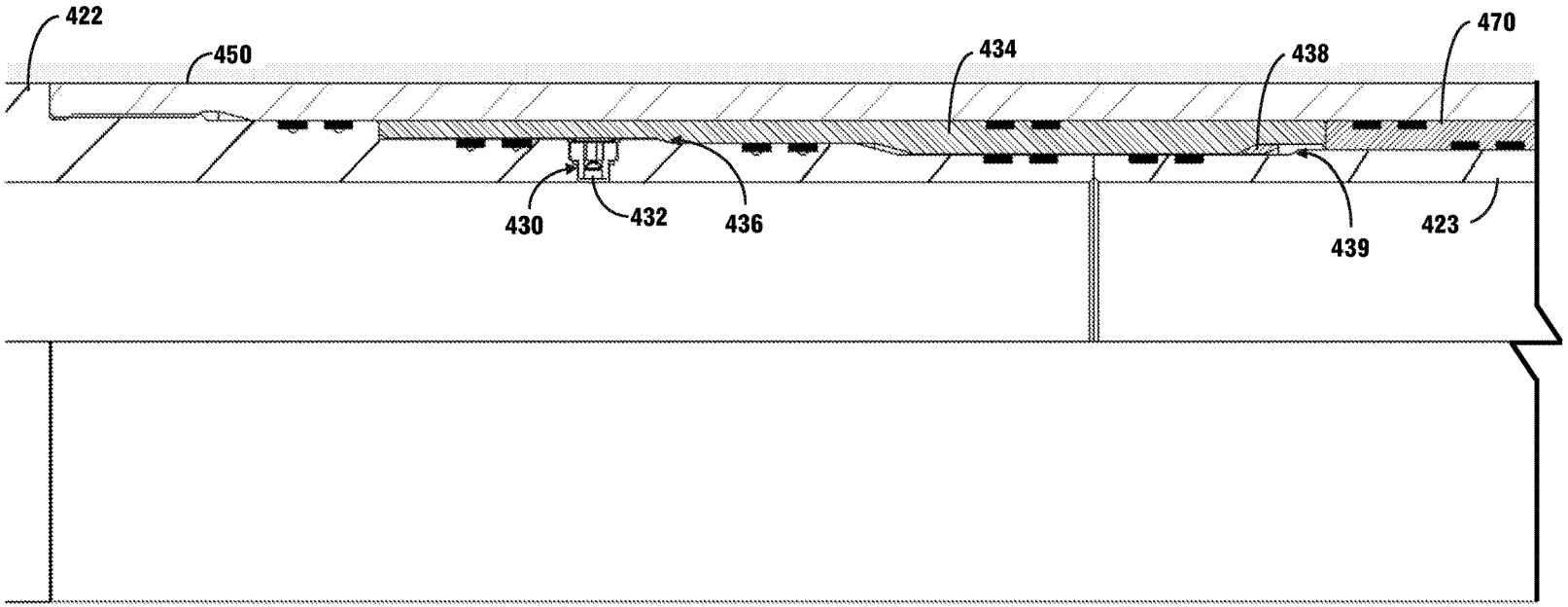
FIGS. 11A-11C are partial side elevations showing one embodiment tool with a telescoping nested ratchet assembly in the run in position.
Figure 11B:
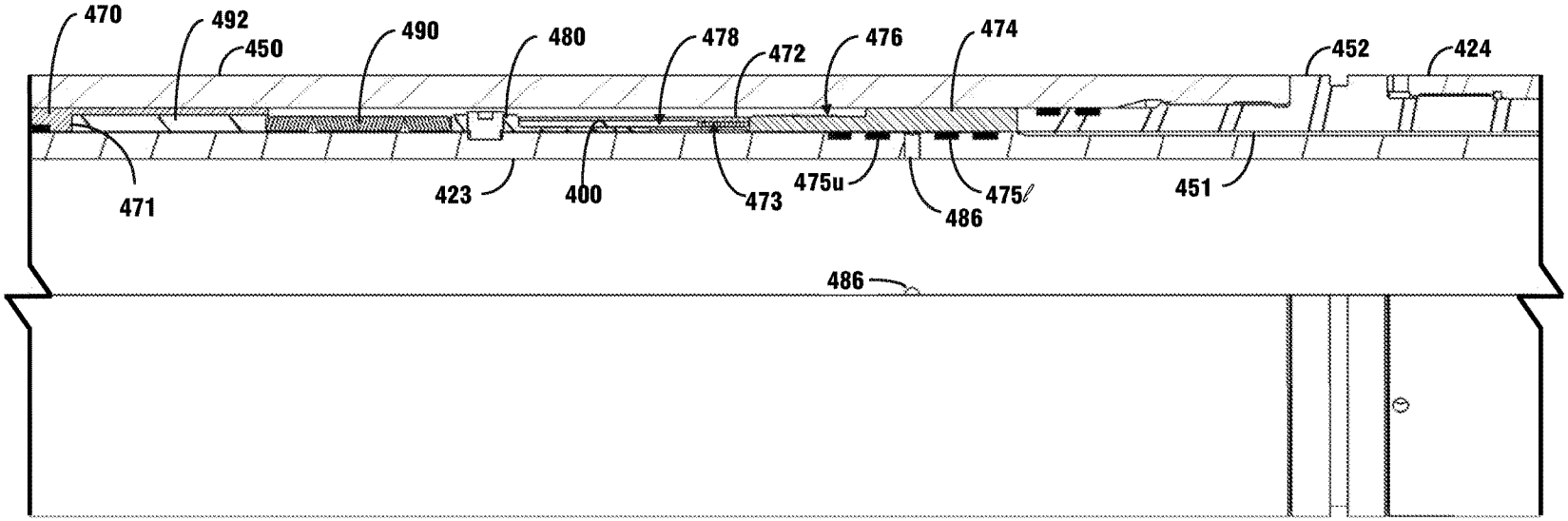
Figure 11C:
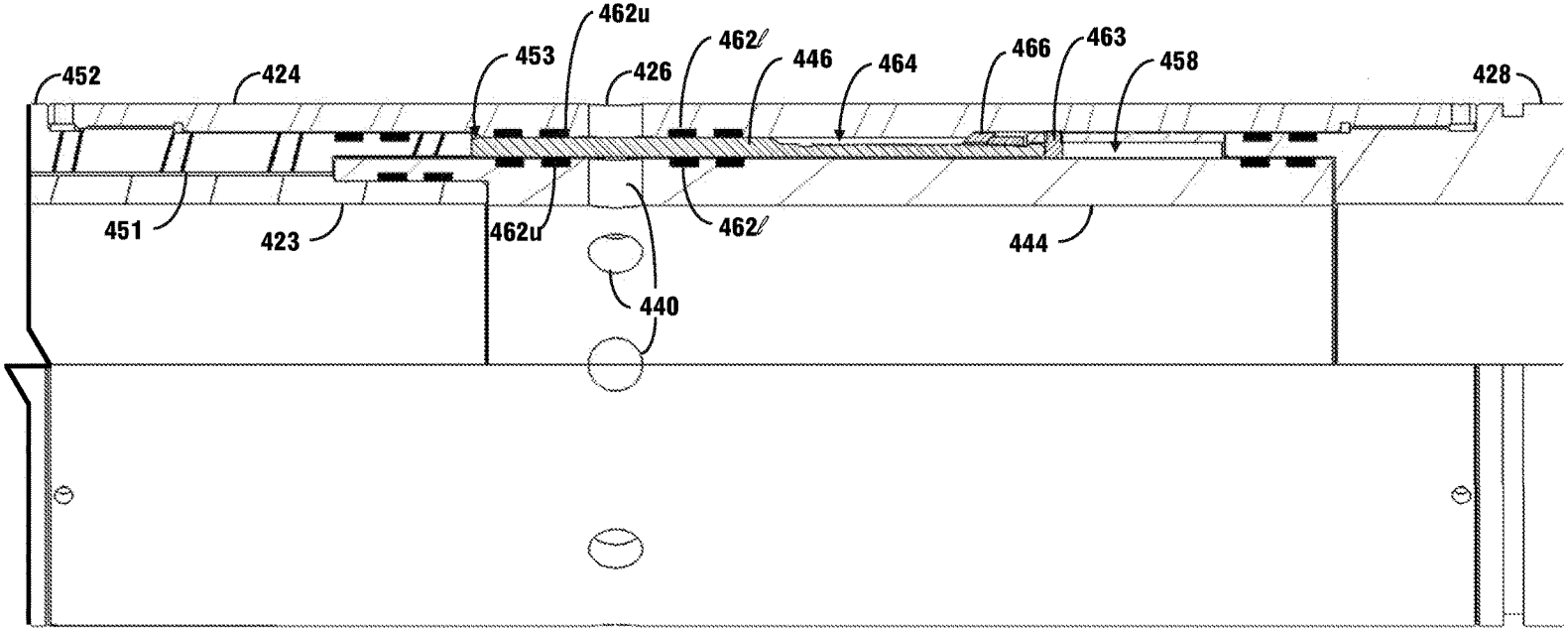

FIG. 11B illustrates the middle portion of the tool including pressure sleeve 470, spring stack 490, retaining sleeve 480 and indexing sleeve 474, arranged as described with respect to FIG. 10. The view in FIGS. 11A-C is rotated around the longitudinal axis of the tool, such that the longitudinal section of FIG. 11B passes through a gap between two indexing collet fingers 472 as well between two retaining collet fingers 478. Retaining sleeve 474 is adjacent to a cross over sub 452 which defines an end of the annular space and connects the housing 450 with the ported housing 424 of a nested sleeve valve.

In the embodiment FIGS. 11-14, crossover sub 452 connects the indexing element, including the indexing sleeve 474, with a nested sleeve sliding valve (shown in FIG. 11C) similar to the valve in FIGS. 1-4. The nested sleeve assembly generally comprises a ported housing 424, a ported inner sleeve 444, with a shifting sleeve 446 in the annular space 464 therebetween. The ends of the annular space are defined by crossover sub 452 and the bottom sub 428. The shifting sleeve 446 is positioned between sleeve ports 440 of the ported inner sleeve 444 and housing ports 426 of the ported housing 424. Seals 462*u* and 462*l* prevent fluid communication from the exterior of the tool and the interior flowpath into inlet pressure chamber 453 and outlet pressure chamber 458 as well as preventing fluid communication between the exterior of the tool and interior flowpath around the ends of shifting sleeve 446. Shifting sleeve 446 may have teeth configured to engage opposing teeth on locking ring 466. One or more shear pins 463, or other retaining device, may be in communication with the shifting sleeve to prevent the shifting sleeve from moving until the fluid pressure in the inlet pressure chamber 453 is sufficiently higher than the fluid pressure in outlet pressure chamber that the force across the shifting sleeve 446 created by such pressure differential is sufficient to break the shear pins 463 or otherwise overcome the retaining device.

It will be appreciated that bottom sub 428 may comprise an outlet conduit, such as, without limitation, the outlet conduits described with respect to FIGS. 6-12 of applicant's U.S. patent application Ser. No. 14/211,122 filed on Mar. 14, 2014 and entitled Downhole Tools, System, and Methods of Using, the disclosure of which is incorporated by reference herein. The inclusion of such an outlet conduit may permit actuation of another tool connected to the outlet conduit via tubing, a flowline, or other device. Further, pressure may be applied to the piston 434 via an inlet conduit, rather than through a passageway, such as passageway 430. Certain embodiment inlet conduits are also disclosed in FIGS. 6-12 of applicant's U.S. patent application Ser. No. 14/211,133 which are incorporated herein by reference.

Figure 12A:
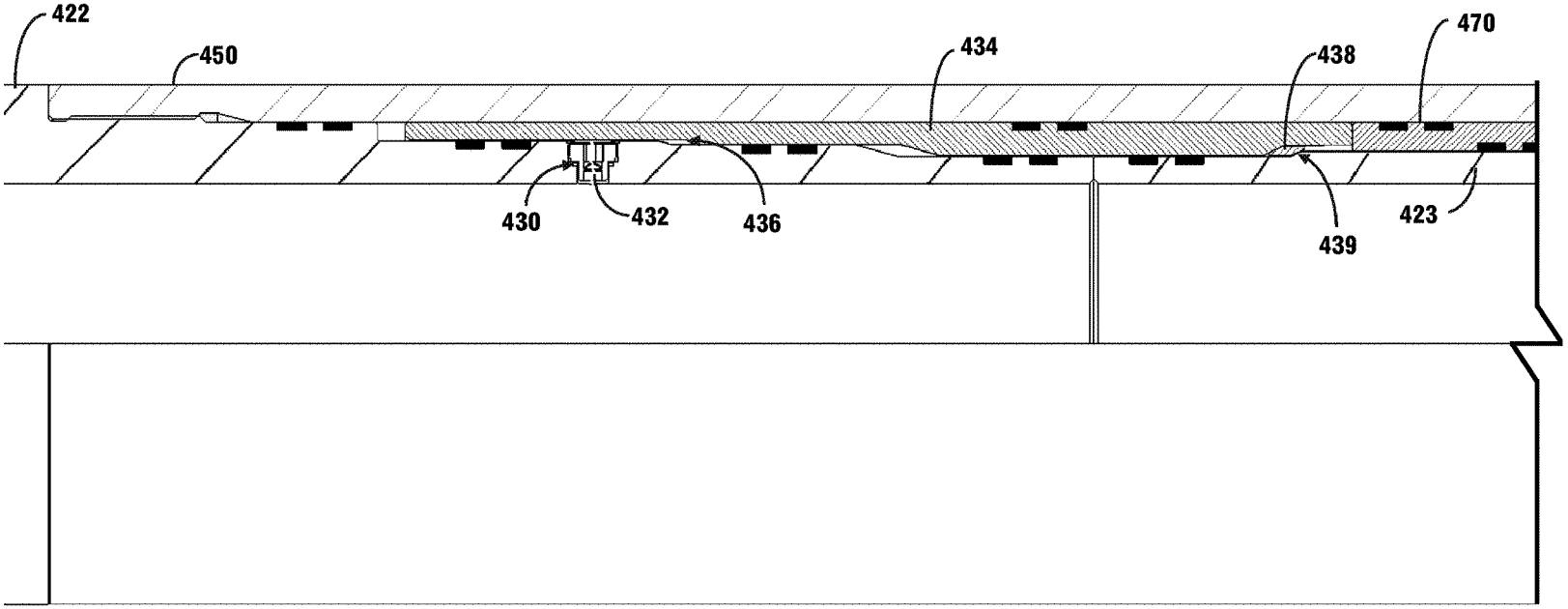
FIGS. 12A-12C are partial side elevations showing an embodiment tool with the telescoping ratchet assembly during the high pressure portion of a pressure cycle.
Figure 12B:
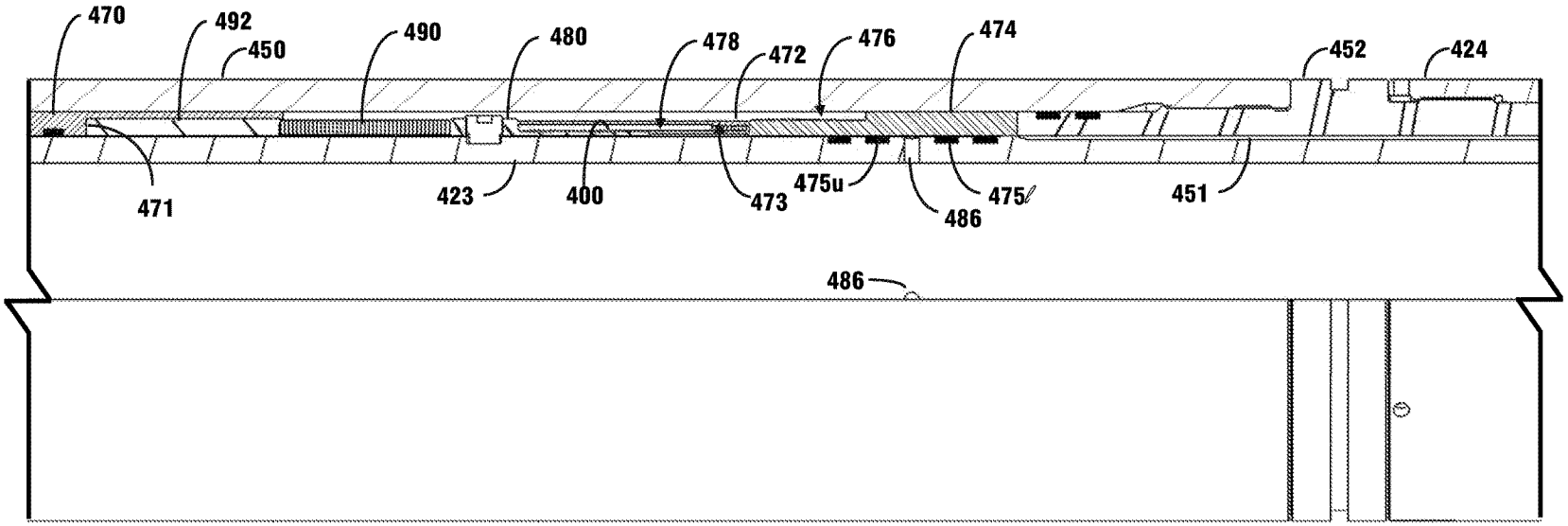
Figure 12C:
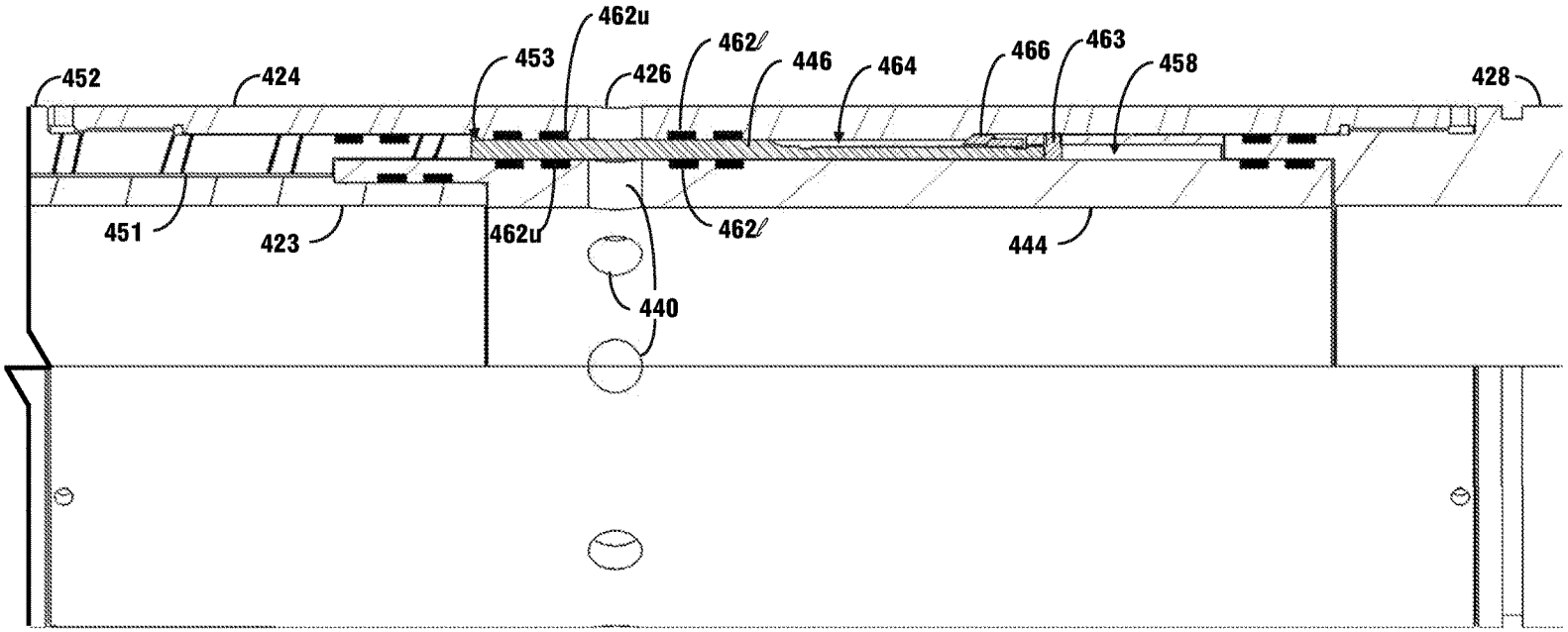

FIGS. 12-14 illustrate the embodiment downhole tool of FIGS. 11A-C through its cycles of operation. In FIGS. 12A-B, fluid pressure sufficient to rupture the burst disk is applied to the fluid in the interior flowpath of the tool according to known methods. Rupture of the burst disk permits the fluid, and thereby fluid pressure, to be communicated to the pressure surface 436 of the piston 434. If the fluid pressure applied to the fluid surface 436 applies sufficient force to overcome the spring stack 490, the frictional forces against the piston 434 and the pressure sleeve 470, and any other forces resisting movement of the pressure sleeve 470 or piston 434, the piston 434 will shift, pushing the pressure sleeve 470 and thereby compressing the one or more springs in the spring stack 490. The piston 434 and pressure sleeve 470 advance until a stop, such as stop ring 438 engages a barrier such as stop shoulder 439, limiting travel of the piston 434 and the pressure sleeve 470. It will be appreciated that the stop shoulder 439, or similar barrier may not be required in certain embodiments as the retaining shoulder 481 and spring stack 490 may serve as a stop when the spring stack 490 is fully compressed. Engagement of stop shoulder 439 by stop ring 438, however, may limit the load applied to retaining sleeve 480, reducing the chance retaining sleeve 480 will fail.

When the force applied to the pressure sleeve 470 is sufficient for the pressure sleeve 470 to compress the spring stack 490, the indexing ratchet advances by the same distance that the spring stack 490 has compressed. In the embodiment of FIG. 12B, indexing collet fingers 472 have advanced relative to the indexing sleeve 474 such that indexing pawl teeth 473 partially overlap with and engage indexing rack teeth 476. Because indexing sleeve 474 remains engaged with seal 475*l*, inlet pressure chamber 453 remains isolated from the interior flowpath and the shifting sleeve 446 remains in the original closed position shown in FIG. 12C.

At this point, the tubing string in which such tool is installed may be subjected to a pressure test by increasing the pressure in the tubing to a desired value. While the test generally should not exceed the burst rating of the downhole tool, the pressure test can be conducted at any acceptable value for any desired length of time. The engagement of stop ring 438, when present, with stop shoulder 439 holds the force that such pressure test applies and prevents larger force from being transferred to pressure sleeve 470, spring stack 490 and retaining sleeve 480.

Figure 13A:
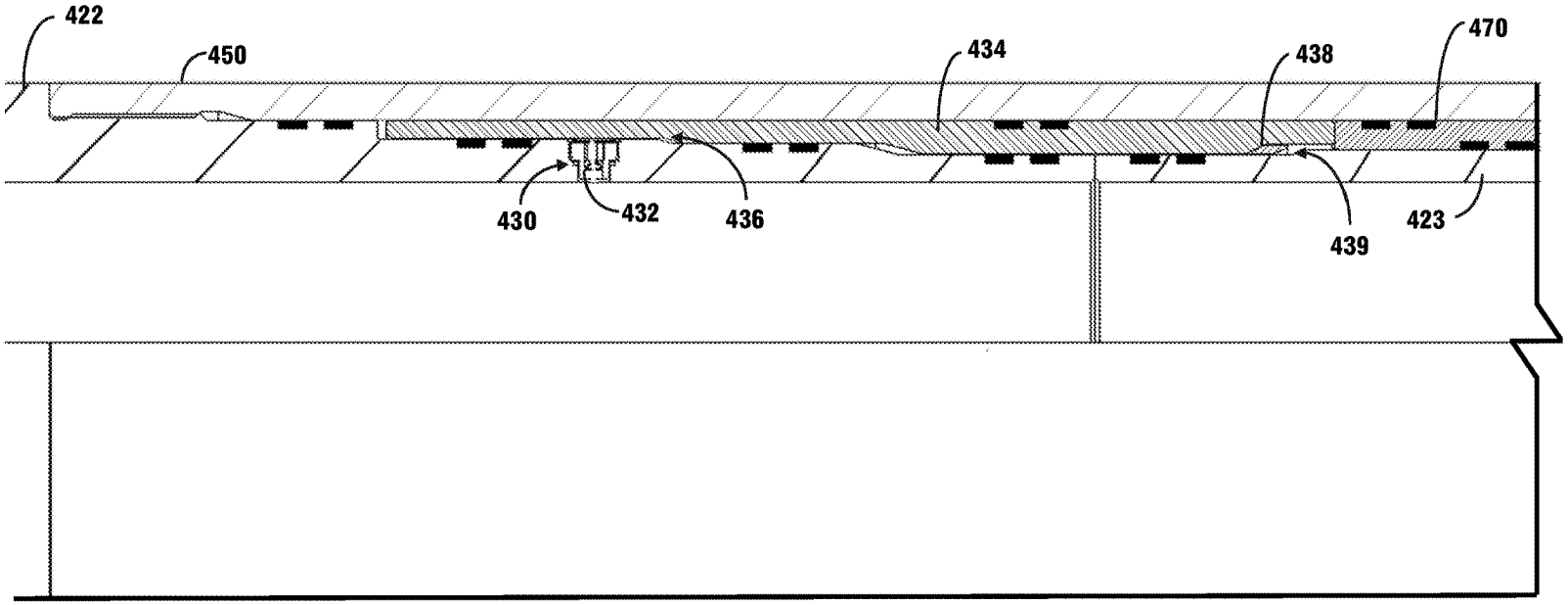
FIGS. 13A-13C are partial side elevations showing an embodiment tool after a complete pressure cycle.
Figure 13B:
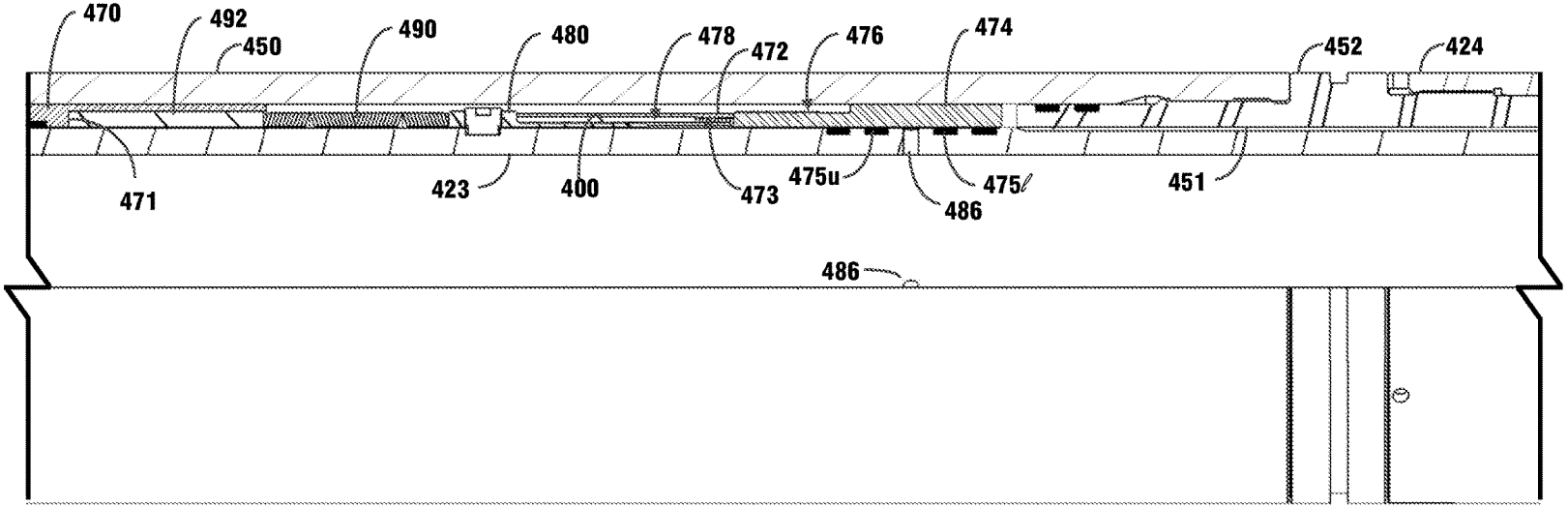
Figure 13C:
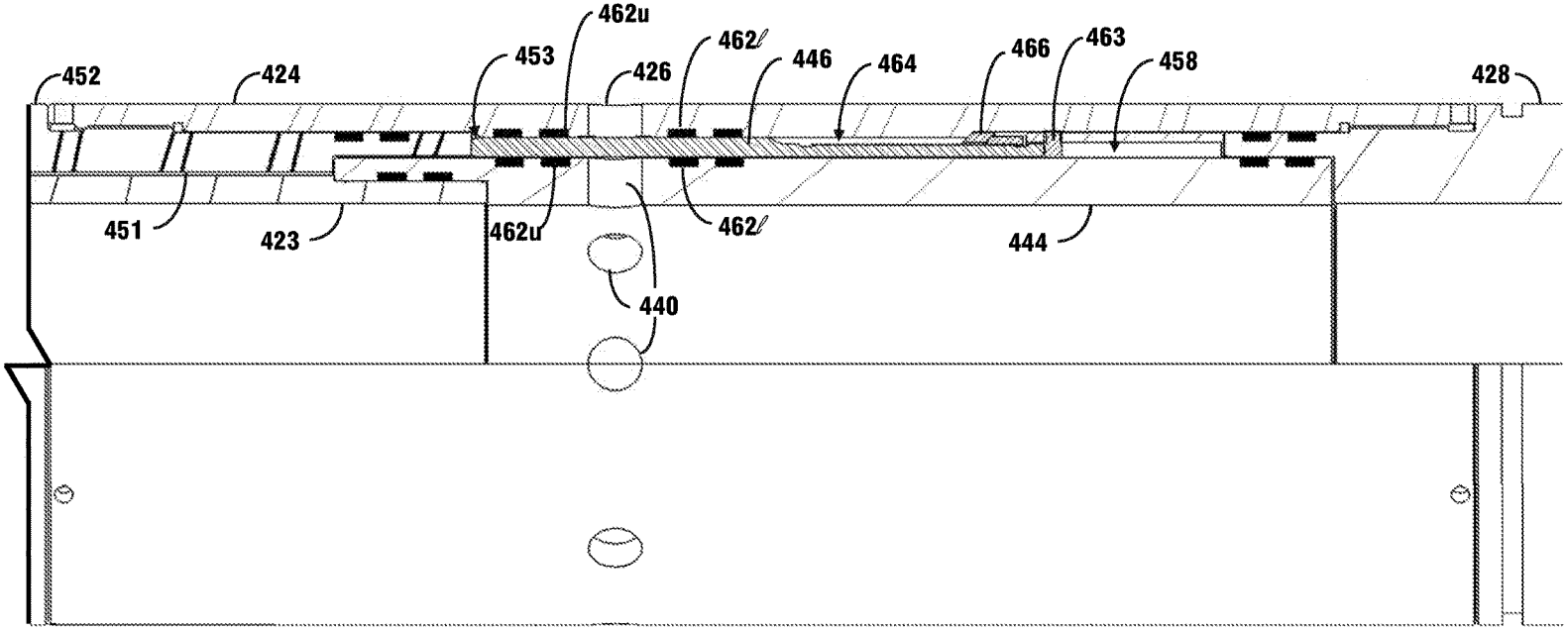

Fluid pressure from in the interior flowpath may then be reduced, reducing the force applied to the pressure surface 436 and consequently to the piston 434. Spring stack 490 will begin to expand, pushing pressure sleeve 470 and piston 434 in the opposite direction and into a neutral position. Such neutral position will be dictated by either the maximum return travel allowed for the piston 434 and pressure sleeve 470 or by the minimum fluid pressure of the cycle. FIG. 13A shows the piston 434 and pressure sleeve 470 in a neutral position between the piston's 434 and pressure sleeve's 470 initial position (shown in FIG. 11A) and the advanced position to which they may be forced to advance the indexing ratchet (shown in FIG. 12A. It will be appreciated that, in the embodiment of FIG. 13A-B, the neutral position of the pressure sleeve 470 at the beginning of the cycle will affect the stroke length for that cycle.

Movement of pressure sleeve 470 from an advanced position to the neutral position causes indexing sleeve 474 to advance towards its actuated position, e.g. the open position for the embodiment of FIGS. 11-14. Specifically, when the indexing ratchet advances, the indexing pawl teeth 473 engages the indexing rack 476 at a more advanced location causing the indexing sleeve 474 to be pulled, via the ratchet, as the pressure sleeve 470 travels to its neutral position. In this way, indexing sleeve 474 moves toward the partially open position as shown in FIG. 13B.

Advancement of the indexing sleeve towards the open position may also advance a retaining ratchet, if present. In certain embodiments, such as the embodiment of FIG. 13B, retaining collet fingers 478 extend from the indexing sleeve 474 towards retaining sleeve 480. Retaining pawl teeth 479 on retaining collet fingers 478 oppose retaining rack 400 on the retaining sleeve 480. Thus, advancement of the indexing sleeve 474 towards the open position advances the retaining pawl teeth 479 along the retaining rack 400, holding, or assisting to hold, the indexing sleeve 474 and preventing its movement back towards the fully closed position. It will be appreciated that mechanisms, including use of frictional force from seals 475*u* and 475*l*, other seals, or other structures for preventing the indexing sleeve from moving towards or returning to the fully closed position may be utilized and are within the scope of the present disclosure.

With the indexing sleeve only partly open, indexing sleeve remains engaged with seal 475*l*, and therefore the inlet chamber 453 of the nested sleeve valve remains in fluid isolation from the fluid and fluid pressure in the interior of the device. The nested sleeve therefore remains unactuated, in the condition shown by FIG. 13C.

Figure 14A:
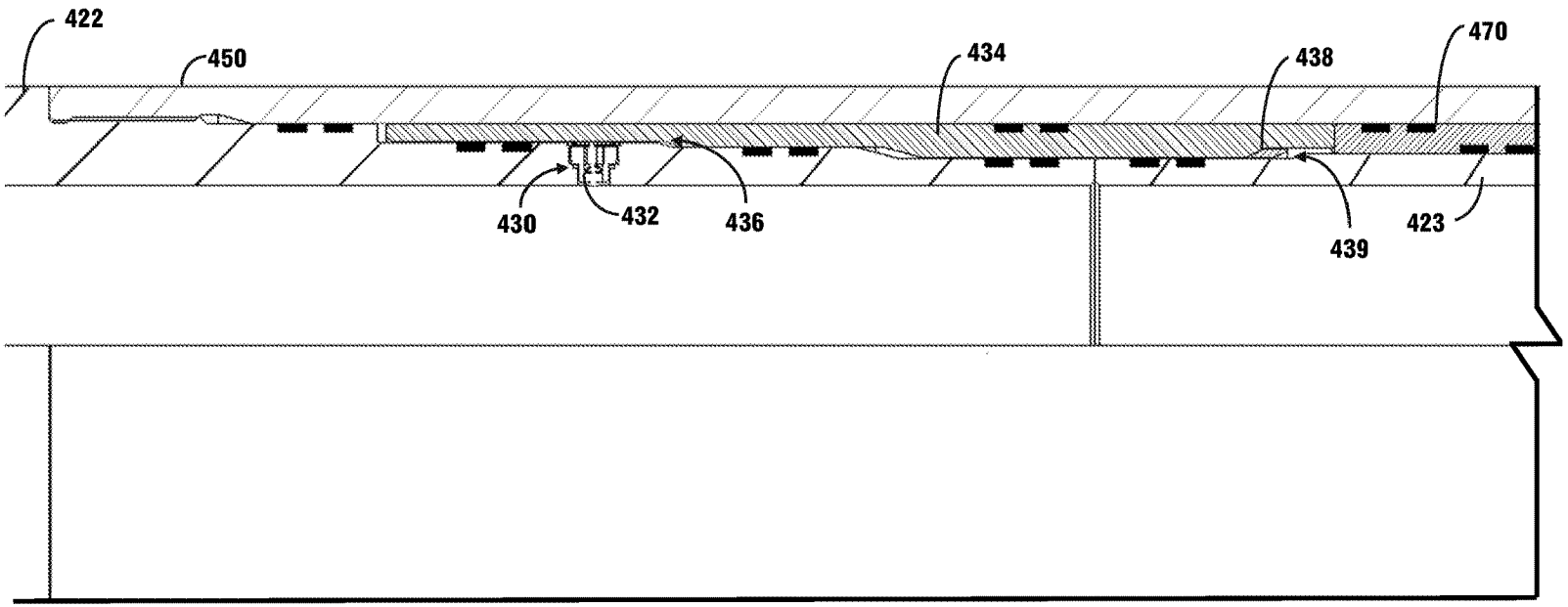
FIGS. 14A-14C are partial side elevations showing an embodiment tool after the trigger has been moved to the open position and the shifting sleeve allowed to open.
Figure 14B:
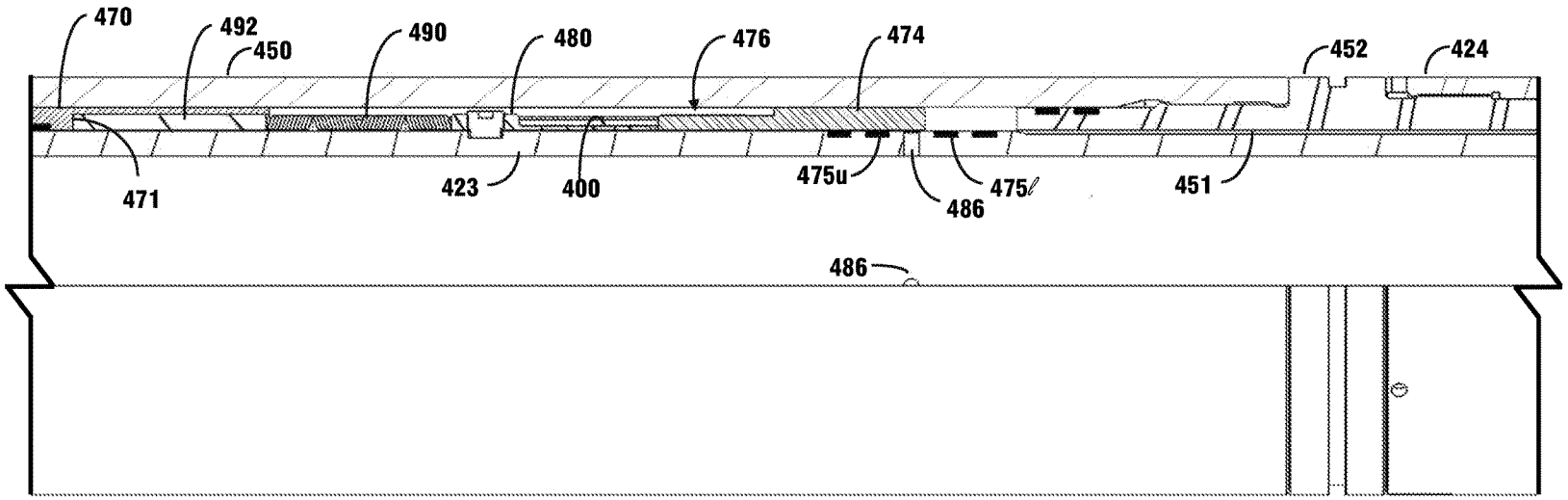
Figure 14C:
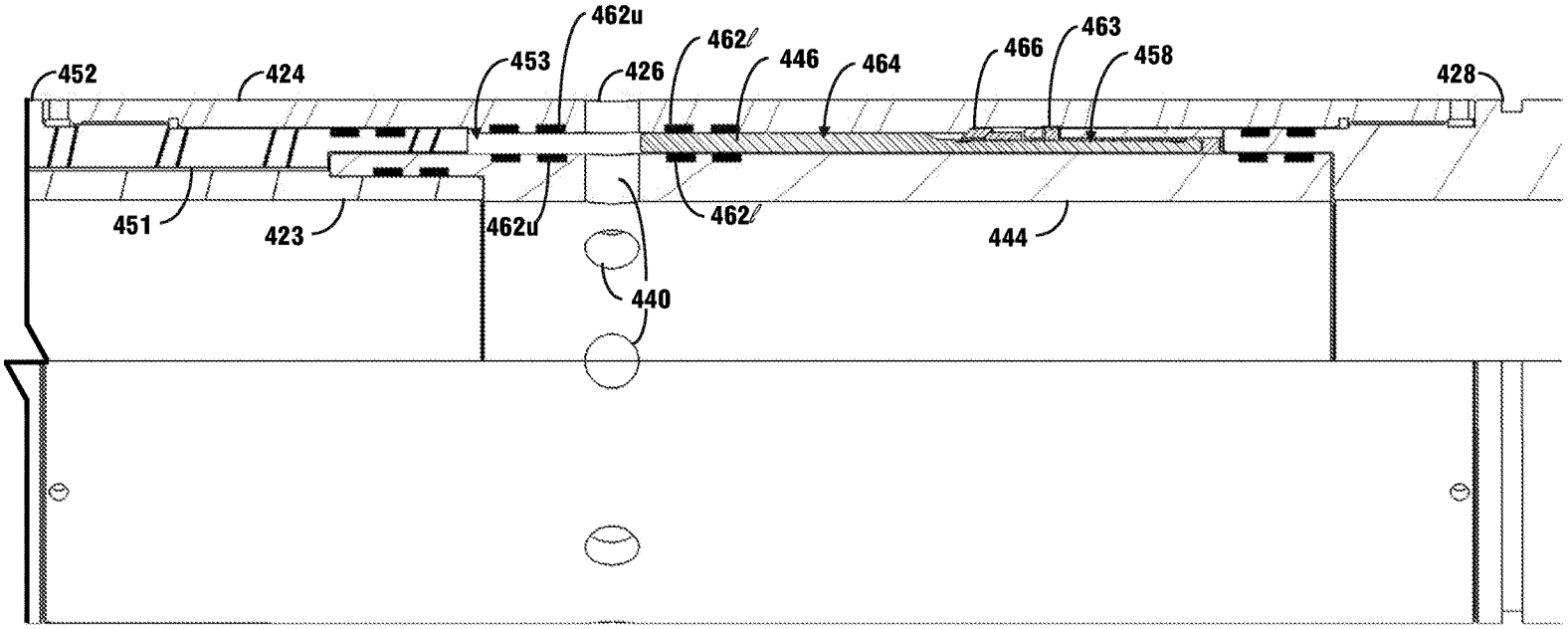

Subsequent cycles (e.g. increased force applied on pressure sleeve 470 to compress the spring stack 490 followed by a reduction in such force to allow the spring stack 490 to expand and move the pressure sleeve to a neutral position) progressively move the indexing sleeve 474 towards the actuated position. As illustrated in FIGS. 14A-C, when the indexing sleeve 474 is moved a sufficient distance that it no longer engages seal 475*l*, fluid communication is established from the interior flowpath through passageway 486, into channel 451, and thereby to inlet pressure chamber 453. Such fluid communication between the interior flowpath with inlet pressure chamber 453 permits the formation of a pressure differential across shifting sleeve 446 which, when the pressure differential reaches a sufficient value as described above, opens the valve by moving the shifting sleeve 446 from the closed to the open position.

From the foregoing description, considerations for selecting a spring, such as spring stack 490, stop ring 438, spring spacer 492, and other components of the disclosed embodiments become readily apparent. For example, the distance necessary for the indexing sleeve 474 to fully open, e.g. for the end of indexing sleeve 474 to clear seal 475*l* may be correlated with the distance between each of the teeth of the indexing rack 476. As one example, the teeth of indexing rack 476 may be set 0.060 inches (sixty thousandths of an inch) apart and the indexing sleeve may need to move 1.4 inches to clear seal 475*l*. In such an arrangement, the indexing pawl teeth 473 must advance twenty-four teeth along the indexing rack 476 in order to move the indexing sleeve 474 to the open position. Thus, if six cycles are desired prior to opening the indexing sleeve, each cycle must advance the indexing ratchet an average of four teeth. In many embodiments, such average will be accomplished by setting the indexing ratchet to advance the same number of teeth for each cycle.

Having determined the number of teeth for advancing the ratchet on each cycle, the stroke length for the indexing assembly may be established by correlating the stroke length with the desired number of teeth to advance with each stroke. In the above example, a stroke length between 0.24 inches and 0.30 inches will advance the indexing ratchet four teeth per cycle, thereby moving indexing sleeve 0.24 inches. Thus, the sum of the stroke lengths for the cycles used to move the indexing sleeve to the open position may be greater than the total distance moved by the indexing sleeve, but, in the illustrated embodiments, the two distances will be correlated through the number of teeth the ratchet assembly advances during each pressure cycle.

The stroke length may be established by selecting an appropriate stop, such as a stop ring 438 or by allowing full compression of the spring. Further the stroke length may be selected or even changed following installation of the downhole tool in a well by controlling the maximum cycle pressure—such that the spring deflects a known maximum distance based on the load—or by controlling the minimum cycle pressure—such that the spring expands only partially, limiting the available travel for the next cycle—or combinations of all of the above.

For example, the spring, such as spring stack 490, may be in a fully expanded condition when the indexing assembly is in the initial condition, e.g. when the tool is installed in a well. Upon rupture of the burst disk, fluid pressure, which may be hydrostatic pressure in the interior flowpath, will apply force to the piston 434, partially compressing the spring. The stroke length associated with the first cycle will include this initial compression plus further compression from additional fluid pressure applied to advance the piston 434 until a stop, such as full spring compression or engagement of stop ring 438 on stop shoulder 439, is reached. When the added fluid pressure is removed, the spring will partially expand, remaining partially compressed by the force that the fluid in the interior flowpath continues to exert on the pressure surface 436 of the piston 434. Such force may be the force from hydrostatic pressure or may be a higher pressure applied to the fluid using known methods. It will be appreciated that this arrangement allows the number of cycles to be increased above the predicted minimum number by applying a minimum cycle pressure that is above hydrostatic pressure and decreasing the stroke length the pressure cycles.

A fluid pressure in the interior flowpath may also be used in conjunction with the compressive strength of the spring stack 490 to determine a neutral position for the piston 430 and pressure sleeve 470. In fact, a plurality of neutral positions may be determined based on a range of possible fluid pressures in the interior flowpath. For example, a hydrostatic pressure in the installed tubing string of 1000 psi may advance the selected spring stack 0.1 inches, reducing, in some embodiments, stroke length from approximately one-half inch to approximately 0.4 inches, and reducing the number of teeth advanced from 6 to 5 if the teeth are spaced 0.060 inches apart. Thus, it is necessary to cycle the indexing assembly 5 times rather 4 to move the indexing sleeve a total of 1.26 inches (21 teeth). If the fluid pressure in the interior flowpath is maintained at a higher pressure, the spring remains more compressed, the stroke length is shortened further, and the indexing sleeve 474 advances towards the actuated position less distance for each such cycle. Thus, the number of cycles can be controlled, within a certain range, by using fluid pressure to define the neutral position.

Figure 15A:
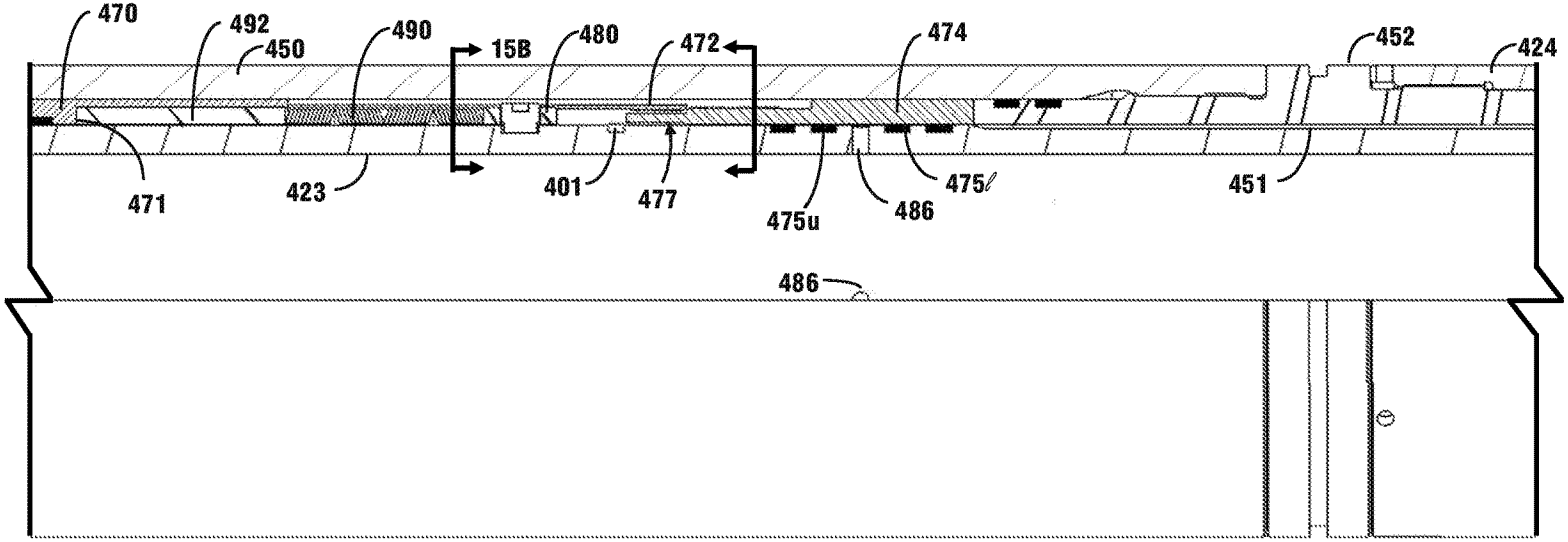
FIGS. 15A-15B are partial side elevations showing an embodiment indexing ratcheting assembly utilizing a ratchet ring and opposing teeth.
Figure 15B:
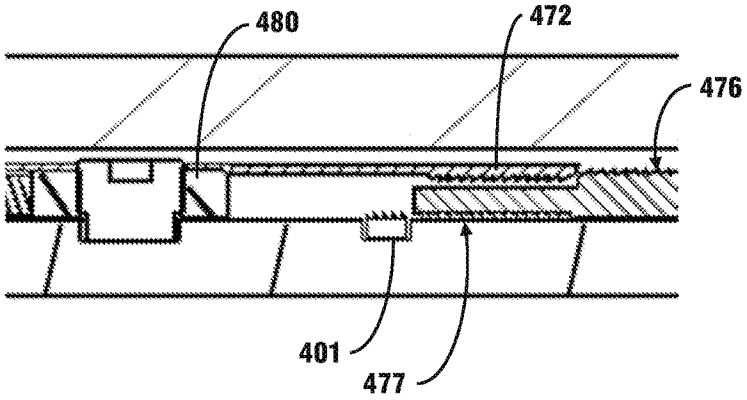

FIGS. 15A-15B disclose an alternative embodiment ratchet assembly utilized as a retaining element. Pressure sleeve 470, spring stack 490, retaining sleeve 480 and indexing sleeve 474 are disposed in an annular space between housing 450 and inner sleeve 423. Indexing collet fingers 472 are configured to engage indexing rack 476 of indexing sleeve 474. Indexing sleeve has a retaining rack 477 which is configured to engage retaining ratchet ring 401 as indexing sleeve 474 is pulled over the ratchet ring. It will be appreciated that such a ratchet ring and rack assembly could also be used for the indexing ratchet as well as for the retaining element.

It will be appreciated that the disclosed embodiments may contain redundant seals and such seals may be included or excluded provided that fluid integrity is maintained as necessary. For example, FIG. 12A illustrates piston 434 and pressure sleeve 470 without seals shown to be present in FIG. 11A.

The present disclosure includes preferred or illustrative embodiments in which specific tools are described. Alternative embodiments of such tools can be used in carrying out the invention as claimed and such alternative embodiments are limited only by the claims themselves. Other aspects and advantages of embodiments according to the present disclosure and the invention as claimed may be obtained from a study of this disclosure and the drawings, along with the appended claims.

We claim:

1. A downhole tool having an exterior, the tool comprising:

a nested sleeve assembly comprising a shifting sleeve, the shifting sleeve having a first position and a second position;

an indexing assembly in communication with the shifting sleeve, the indexing assembly having an actuated position and at least one non-actuated position;

a pressure sleeve moveable in response to fluid pressure in an interior flowpath of the tool;

a fluid control device; and a spring;

wherein, the indexing assembly advances from the at least one non-actuated position to the actuated position in response to a predetermined stimulus;

the indexing assembly prevents the nested sleeve from moving to the second position when the indexing assembly is in the at least one non-actuated position;

the spring opposes movement of the pressure sleeve towards the fluid control device;

the fluid control device is slidable relative to the pressure sleeve in a first direction and fixed relative to the pressure sleeve in a second direction substantially opposite to the first direction; and movement of the pressure sleeve in the second direction moves the fluid control device towards an actuated position.

2. The downhole tool of claim 1 wherein the spring opposes movement of the pressure sleeve in the first direction.

3. The downhole tool of claim 1 wherein the indexing assembly comprises a fluid control device.

4. The downhole tool of claim 1 wherein the indexing assembly comprises at least one ratchet assembly.

5. The downhole tool of claim 4, wherein the at least one ratchet assembly comprises collet fingers having teeth thereon and a sliding sleeve comprising a rack for engaging the teeth.

6. The downhole tool of claim 1 wherein the shifting sleeve remains in the closed position until the indexing assembly reaches the actuated position.

7. A method for actuating a downhole tool, the method comprising flowing a fluid into the downhole tool, the downhole tool comprising:

a nested sleeve assembly having a shifting sleeve and a passageway connecting at least one surface of the shifting sleeve with a flowpath of the downhole tool, the shifting sleeve having a first position and a second position;

an indexing assembly comprising a pressure sleeve with an advanced position and a neutral position, a spring, and a fluid control device; the pressure sleeve engaged with the fluid control device when moving in a first direction and not engaged with the fluid control device when moving in a second direction substantially opposite the first direction;

applying a fluid pressure cycle to the fluid in the downhole tool; the pressure cycle comprising a high pressure on the fluid sufficient to move the pressure sleeve and compress the spring a desired amount and a low pressure on the fluid permitting the spring to return the pressure sleeve to a neutral position;

moving the pressure sleeve and the fluid control in the first direction during the pressure cycle;

moving the pressure sleeve in the second direction during the pressure cycle, thereby advancing the indexing assembly repeating the pressure cycle until the fluid control device is moved from a closed position to an open position in response to the plurality of pressure cycles.

8. The method of claim 7 further comprising flowing cement through tool before the first of said plurality of pressure cycles.

9. The method of claim 7 further comprising conducting a pressure test before the fluid control device reaches the open position, wherein the pressure of the fluid in the interior flowpath is increased to a pressure at least as high as a maximum treating pressure predicted to be applied for treating a well within which the downhole tool is placed.

10. A downhole tool having an exterior, the tool comprising:

a nested sleeve assembly comprising a shifting sleeve, the shifting sleeve having a first position and a second position; and an indexing assembly in communication with the shifting sleeve, the indexing assembly having an actuated position and at least one non-actuated position and at least one ratchet assembly, the ratchet assembly comprising collet fingers having teeth thereon and a sliding sleeve with a rack for engaging the teeth;

wherein the indexing assembly advances from the at least one non-actuated position to the actuated position in response to a predetermined stimulus; and further, wherein the indexing assembly prevents the nested sleeve from moving to the second position when the indexing assembly is in the at least one non-actuated position.

11. The downhole tool of claim 10 wherein the indexing assembly comprises a pressure sleeve moveable in response to fluid pressure in an interior flowpath of the tool, a fluid control device, a spring, wherein the spring opposes movement of the pressure sleeve towards the fluid control device the fluid control device is slidable relative to the pressure sleeve in a first direction and fixed relative to the pressure sleeve in a second direction substantially opposite to the first direction;

movement of the pressure sleeve in the second direction moves the fluid control device towards an actuated position; and the spring opposes movement of the pressure sleeve in the first direction.

12. The downhole tool of claim 10 wherein the indexing assembly comprises a fluid control device.

13. The downhole tool of claim 10 wherein the shifting sleeve remains in the closed position until the indexing assembly reaches the actuated position.

14. The downhole tool of claim 10 wherein advancing of the indexing assembly comprises movement of the collet fingers along the rack.

* * * * *